US006523810B2

(12) United States Patent
Offir et al.

(10) Patent No.: US 6,523,810 B2
(45) Date of Patent: Feb. 25, 2003

(54) MODULAR PERFORMANCE INDICATOR FOR A HUMIDIFIER

(75) Inventors: Yigal Offir, Hopkinton, MA (US); Paul J. Powers, Jr., Southboro, MA (US); Robert A. Barker, Berlin, MA (US); Nalini Bihani, Newton, MA (US); Ricardo Silveira, New Bedford, MA (US); Danny J. Xu, Quincy, MA (US)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/968,750

(22) Filed: Oct. 2, 2001

(65) Prior Publication Data

US 2002/0050656 A1 May 2, 2002

Related U.S. Application Data

(63) Continuation-in-part of application No. 09/728,017, filed on Dec. 1, 2000, now Pat. No. 6,308,939, which is a continuation of application No. 09/227,382, filed on Jan. 8, 1999, now Pat. No. 6,237,899.

(60) Provisional application No. 60/072,378, filed on Jan. 9, 1998.

(51) Int. Cl.[7] ..... B01F 3/04

(52) U.S. Cl. ..... 261/72.1; 261/107; 261/DIG. 65; 73/29.02; 73/29.05

(58) Field of Search ..... 261/72.1, 107, 261/DIG. 4, DIG. 65; 73/29.02, 29.01, 29.05

(56) References Cited

U.S. PATENT DOCUMENTS

| | | | | |
|---|---|---|---|---|
| 1,970,301 A | | 8/1934 | Frankel | |
| 2,059,846 A | | 11/1936 | Bulger | |
| 2,114,105 A | | 4/1938 | Gerber | |
| 2,128,462 A | | 8/1938 | Kahn et al. | |
| 2,411,041 A | | 11/1946 | Kahn | |
| 2,815,662 A | * | 12/1957 | Thomas | 73/29.02 |
| 3,425,388 A | | 2/1969 | West | |
| 4,150,571 A | | 4/1979 | Hayes et al. | |
| 4,175,422 A | | 11/1979 | Owen | |
| 4,210,278 A | | 7/1980 | Obler | |
| 4,687,050 A | | 8/1987 | Podlipnik | |
| 5,285,960 A | | 2/1994 | Zografos | |
| 5,309,726 A | | 5/1994 | Asbridge | |
| 5,364,024 A | | 11/1994 | Lin | |
| 5,800,741 A | | 9/1998 | Glenn et al. | |
| 5,903,223 A | | 5/1999 | Howell | |
| 5,971,205 A | | 10/1999 | Michaels et al. | |

* cited by examiner

*Primary Examiner*—Robert A. Hopkins
(74) *Attorney, Agent, or Firm*—Hoffmann & Baron, LLP; Francis E. Marino

(57) ABSTRACT

A humidifier includes a modular performance indicator that is removably attached to a grill of the humidifier air outlet. The performance indicator generally includes at least one humidity sensing means and a display. The humidity sensing means is positioned within the airflow for measuring the exit-relative humidity of the airflow and the display is coupled to the humidity sensing means for indicating when the humidifier wick requires replacement and/or the humidifier water supply requires refilling based upon the measured exit-relative humidity reaching a predetermined value.

29 Claims, 26 Drawing Sheets

MODULAR PERFORMANCE INDICATOR FOR A HUMIDIFIER

CROSS-REFERENCE TO RELATED APPLICATIONS

This application is a Continuation-in-part of U.S. application Ser. No. 09/728,017, filed Dec. 1, 2000, now U.S. Pat. No. 6,308,939 which is a Continuation of U.S. application Ser. No. 09/227,382, filed Jan. 8, 1999, now U.S. Pat. No. 6,237,899, which claims the benefit of U.S. Provisional Application No. 60/072,378 filed Jan. 9, 1998.

FIELD OF THE INVENTION

The present invention relates to an evaporative humidifier having a removable indicator for indicating when a wick element requires replacement and/or a water supply requires refilling. More particularly, the present invention relates to a modular indicator that is removably attached to an air outlet grill of a humidifier for monitoring the performance of the humidifier.

BACKGROUND OF THE INVENTION

Humidifiers are useful in raising the humidity of air inside homes, particularly during periods of dry weather during the winter and heat inside a home causes the relative humidity within the home to be lowered to an uncomfortable level. Under these circumstances, it is beneficial to introduce moisture into the air. Several types of humidifiers for increasing humidity in a room are well known in the art, and include steam-type, ultrasonic, warm-air and evaporative humidifiers.

Certain humidifiers, and in particular the evaporative type, generally include a housing having an inlet, an outlet, and a reservoir for holding water, a water absorbing material seated partially submerged in the water of the reservoir, and a fan that is connected to the housing for creating an airflow. The water absorbing material is generally known as a wick in the art and is adapted to draw water in the upper nonimmersed part by capillary action. The airflow created by the fan is directed to pass through the upper non-immersed portion of the wick to humidify the air in the room.

A problem associated with humidifiers that utilize wicks is that they tend to accumulate minerals from the water which blocks the capillary action of the wick. Accordingly, the performance of the wick degrades over time requiring replacement.

It is difficult to determine when a wick requires replacement by physical inspection or by monitoring the period of actual use. This is because both of these methods do not assess the actual performance of the wick. The wick will change color as a result of the absorption of various minerals over a period of a time. Since the minerals that exist in public water supplies vary from one municipality to another, practical replacement guidelines based only on a physical inspection and monitoring the length of use are not practical.

Commonly assigned U.S. Pat. No. 5,800,741 to Glenn et al. discloses an evaporative humidifier having a wick filter with color change indicator. The wick change indicator disclosed therein was premised upon a color change indicator that would change color after a period of use. As noted in the specification at Column 9, Lines 45–53, although the life of the wick filter is estimated to be approximately 6 weeks, the water supply can have an adverse effect on the color change indicator disclosed therein.

OBJECTS AND SUMMARY OF THE INVENTION

It is an object of the present invention to provide a humidifier with a removable humidifier performance indicator.

It is a further object of the present invention to provide a modular indicator that is removably attached to an air outlet grill of a humidifier for monitoring the performance of the humidifier to assess whether the humidifier wick requires replacement and/or the humidifier water supply requires refilling.

It is yet another object of the present invention to provide a modular indicator hat is inexpensive and easy to manufacture.

In accordance with one form of the present invention, a humidifier includes a housing having an air inlet, an air outlet and a reservoir for holding water. The reservoir supports a wick, which is seated therein. A fan is provided within the housing for creating an airflow. The airflow enters the air inlet, passes through the wick for adding moisture to the air and exits through the air outlet. The exiting air has an exit-relative humidity associated therewith. The humidifier further includes a wick change indicator removably attached to the air outlet. The wick change indicator includes a humidity sensing means, such as a hygrometer, positioned within the airflow for measuring the exit-relative humidity of the airflow and a display coupled to the humidity sensing means for indicating when the wick requires replacement based upon the measured exit-relative humidity reaching a predetermined value.

In a preferred embodiment of the present invention, the hygrometer has a humidity sensitive element, which is coupled to an indicating needle providing a visual display that the wick requires replacement. Preferably the humidity sensitive element is a metallic coil. The display includes markings such that the needle is positioned with respect to the markings to provide an indication that the wick needs replacement and/or the reservoir is empty.

In an alternative embodiment of the present invention, the hygrometer is provided as a chemically impregnated label. The label changes color as a function of humidity. The label has a first region that is light in color and darkens when the exit-relative humidity of the airflow reaches a first predetermined value. The label also has a second region that is light in color and darkens when the exit-relative humidity of the airflow reaches a second predetermined value.

In another embodiment of the present invention, the hygrometer is provided in the form of an electrical-type hygrometer, e.g. a resistive or capacitive element whose value varies as a function of sensed humidity, and the display is a liquid crystal type calibrated to indicate that the wick requires replacement when the exit-relative humidity of the airflow falls below a predetermined humidity.

In still a further embodiment of the present invention, the modular wick change indicator includes a second hygrometer that measures the ambient-relative humidity. The wick change indicator has a means for comparing the exit-relative humidity with the ambient-relative humidity for indicating when the wick requires replacement.

Preferably, the air outlet includes a grill and the wick change indicator includes an attachment member for removably attaching the wick change indicator to the grill of the air outlet. The attachment member includes at least one finger projecting outwardly from the wick change indicator for engagement with the grill. In a preferred embodiment, the attachment member includes at least one straight finger projecting outwardly from the wick change indicator and at least one resilient finger projecting outwardly from the wick change indicator at an angle with respect to the straight finger. The at least one straight finger and the at least one resilient finger form an open resilient jaw for frictionally holding at least one slat forming the grill. The modular wick change indicator further preferably includes a retaining ring and a transparent cover attached to the retaining ring for housing the hygrometer and the display therein.

In another alternative embodiment of the present invention, a modular indicator is provided for indicating the need to refill a water supply to a room humidifier. The room humidifier is of the type having an air outlet for providing a flow of air having an exit-relative humidity associated therewith into a room having an ambient-relative humidity. The indicator includes a humidity sensing means positioned within the airflow for measuring the exit-relative humidity of the airflow, a display coupled to the humidity sensing means for indicating when the water supply needs refilling based upon the measured exit-relative humidity substantially reaching a predetermined value and an attachment member for removably attaching the indicator to the air outlet.

In a method for determining when a wick element of a humidifier requires replacement, a wick change indicator having a humidity sensing means and a display coupled to the humidity sensing means is attached to the air outlet of the humidifier. The exit-relative humidity of the flow of air from the air outlet of the humidifier is sensed with the humidity sensing means of the wick change indicator and the display indicates when a predetermined humidity level has been substantially reached to indicate that the wick element should be replaced.

In a method for determining when a water supply of a humidifier requires refilling, an indicator having a humidity sensing means and a display coupled to the humidity sensing means is attached to an air outlet of the humidifier. The exit-relative humidity of the air flowing from the air outlet of the humidifier is sensed with the humidity sensing means of the indicator and the display indicates when a predetermined humidity level has been substantially reached to indicate that the water supply should be refilled.

In a method for determining when a wick element of a humidifier requires replacement or a water supply of the humidifier requires refilling, an indicator having a humidity sensing means and a display coupled to the humidity sensing means is attached to an air outlet of the humidifier. The exit-relative humidity of air flowing from the air outlet of the humidifier is sensed with the humidity sensing means of the indicator and the display indicates when a predetermined humidity level has been substantially reached to indicate that either the wick element should be replaced or the water supply should be refilled.

A preferred form of the humidifier and the removably attachable humidifier performance indicator of the present invention, as well as other embodiments, objects, features and advantages of this invention will be apparent from the following detailed description of illustrative embodiments thereof, which is to be read in connection with the accompanying drawings.

DETAILED DESCRIPTION OF THE PREFERRED EMBODIMENTS

The present invention is directed to a humidifier that has a wick change indicator. The wick change indicator monitors the performance of the wick to assess whether the wick requires replacement. The general features and operation of humidifiers that include a wick are known to those skilled in the art. Examples of humidifiers are described in U.S. Pat. No. 5,800,741 to Glenn et al. the disclosure of which is incorporated herein by reference. A brief summary of the operation of a humidifier having a wick change indicator is set forth below followed by a detailed discussion of the preferred embodiments of the wick change indicator.

Figure 1:
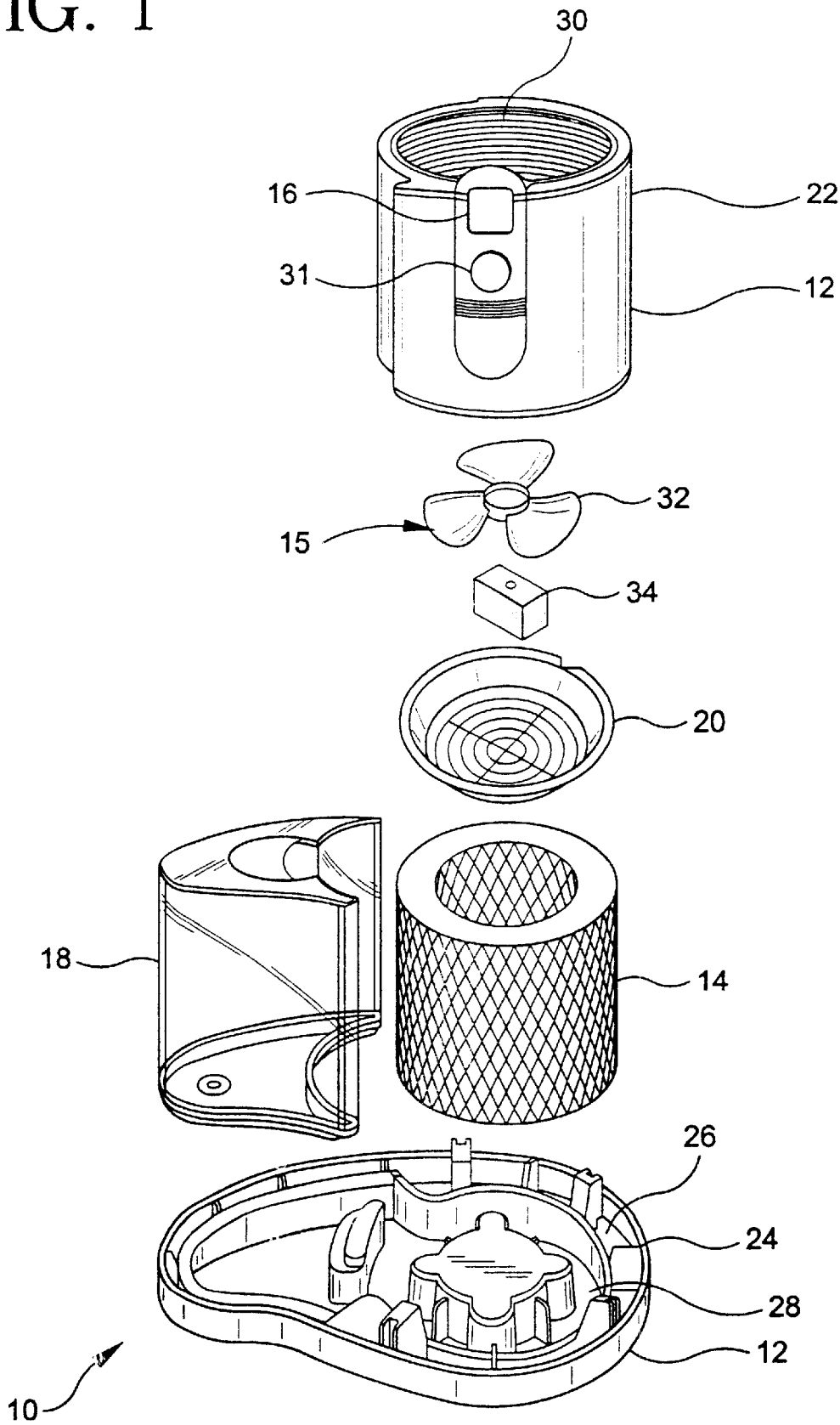
FIG. 1 is an exploded view of a preferred embodiment of the present invention.

Referring now to FIG. 1, a humidifier 10 in accordance with the present invention generally includes a housing 12, a wick 14, a fan 15, and a wick change indicator 16. The humidifier can also include a tank 18 and an air deflector 20.

The housing has an upper portion and bottom portions 22, 24. The bottom portion 24 is formed with an air inlet 26 and a reservoir 28. The reservoir 28 holds water while supporting the wick 14. The tank 18 is removably engageable with the bottom portion 24 and supplies the reservoir 28 with water. The wick 14 is seated in the reservoir 28 so that it is partially submerged in the water. The upper portion 22 is formed with an air outlet 30 and has the fan 15 mounted therein generally above the top of the wick 14. Generally, the upper portion 22 of the housing also supports a control 31 for regulating the fan 15 speed and thus the amount of moisture generated by the humidifier.

The wick 14 is fabricated from a material that absorbs fluids. Preferably the wick is made from expanded cotton/cellulose which has excellent capillary action soaking water in the reservoir up into the entire wick.

The fan 15 generates an airflow through the humidifier 10. Preferably the fan 15 includes a plurality of fan blades 32 that are connected to a motor 34 for generating the airflow. The fan pulls dry outside air up through the moistened wick to provide an exiting airflow carrying moisture therein.

The wick change indicator 16 generally includes at least one humidity sensing means and a display. The humidity sensing means can be any device known in the art that is used to sense and/or measure humidity in air. Preferably, the humidity sensing means is a hygrometer. Thus, the at least one hygrometer is positioned within the airflow for measuring the exit-relative humidity of the airflow. The display is coupled to the hygrometer for indicating when the wick 14 requires replacement based upon the measured exit-relative humidity reaching a predetermined value. Preferably the predetermined value is set at 87 percent.

In the operation of the humidifier 10, water from the tank 18 fills the reservoir 28 to a level so that the wick 14 is partially submerged. Water is drawn up into the non-immersed portion of the wick 14 by capillary action. As earlier discussed, the fan 15 generates an airflow that enters the humidifier 10 through the air inlet 26, passing through the wick 14 where it picks up moisture and exits the humidifier 10 through the air outlet 30. The wick change indicator 16 provides an indication that the wick requires replacement when the exit-relative humidity falls below a predetermined value.

Figure 2B:
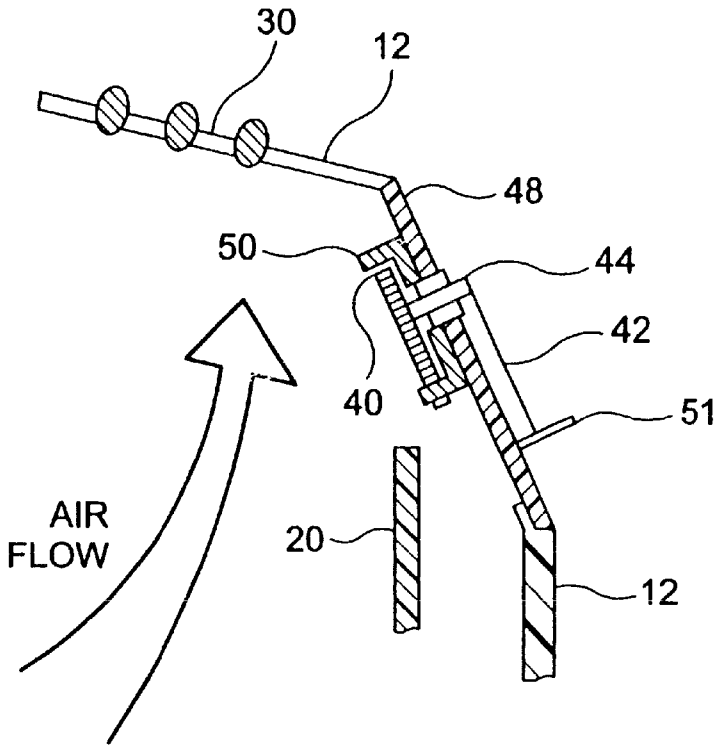
FIG. 2B is a cross-sectional view through the display of a preferred embodiment shown in FIG. 2A.
Figure 2A:
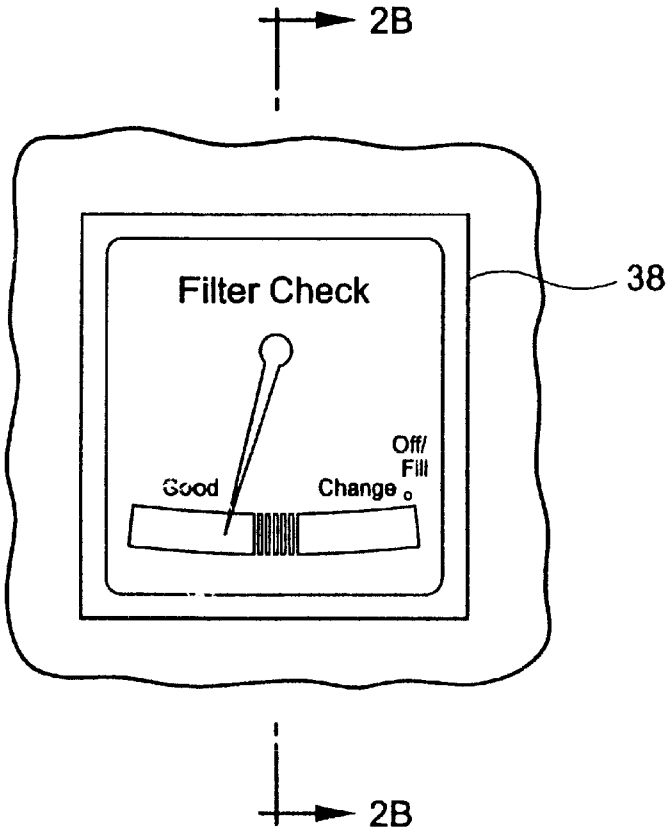
FIG. 2A is an elevational view of a display of a preferred embodiment of the present invention.
Figure 3:
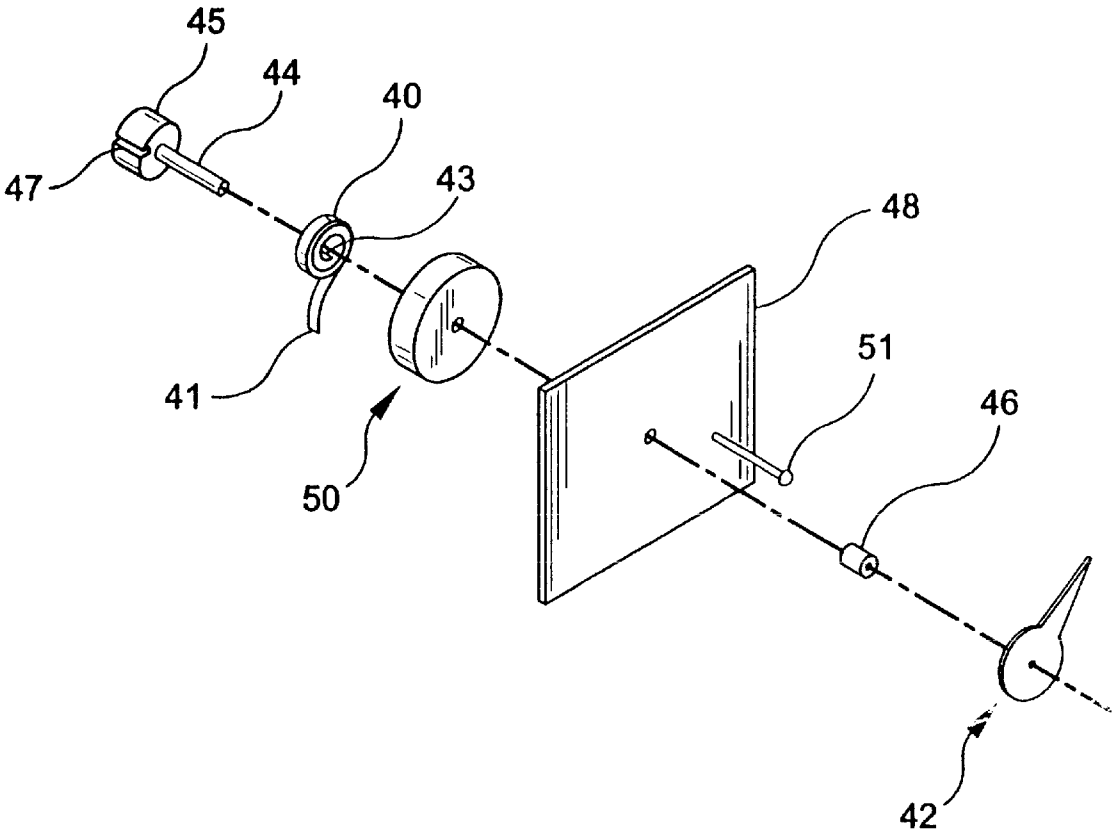
FIG. 3 is an exploded view of a preferred embodiment of the present invention shown in FIGS. 2A and 2B.

Referring now to FIGS. 2A, 2B and 3, a preferred embodiment of the wick change indicator 16 includes a mechanical hygrometer 36 and a display 38. The mechanical hygrometer 36 has a humidity sensitive element 40 and an indicating needle 42 coupled thereto for providing a visual display that the wick 14 requires replacement. Preferably the humidity sensitive element 40 is a metallic coil having a free end 41 and a central end 43. As shown in FIG. 3, the indicating needle 4 is coupled to one end of the humidity sensitive element 40 with a shaft 44 that extends through a bearing 46, which is supported by a support plate 48. The shaft 44 has a thickened portion 45 formed with a slot 47. The internal end 43 of the metallic coil is received by the slot 47 to form the connection between the coil and shaft 44. The support plate 48 can be a separate part that is configured to attach to the housing 12 or it can be integrally formed as part of the housing 12. As shown in FIG. 2B, the humidity sensitive element 40 is positioned within an interior portion of the humidifier 10 with the housing 12 and air deflector 20 being configured to ensure that the element 40 is exposed to the exiting airflow. The exiting airflow has previously been forced through the wick element to pick up moisture for release into a room. The humidity sensitive element 40 is responsive to an exit-relative humidity causing the associated indicating needle 42 to rotate and thus provide an indication of the wick performance. Where the humidity sensitive element 40 is a metallic coil, a holder 50 is preferably provided to restrain the free end 41 of the coil.

The display 38 is formed on the support plate 48 and calibrated with markings based upon the exit-relative humidity to provide an indication that the wick needs replacement. As shown in FIG. 2A, the display 38 is calibrated to indicate the wick needs replacement when the exit-relative humidity falls below about 87 percent.

Since the hygrometer-cannot-differentiate between the humidifier being "off", poor wick performance, or an exhausted water supply, the user must make such a distinction. Operating instructions to check these three possibilities upon an indication of low humidity exiting the humidifier allow the user to determine the cause of poor performance. In order to aid the user, the display 38 is also provided with an "Off/Fill" indicator as shown in FIG. 2A for providing visual indication that the humidifier is either off or needs to be filled with water. This position is indicated when the exit-relative humidity or sensed humidity by the hygrometer is relatively low and below the threshold indicia for filter replacement. A stop pin 51 is provided at the "Off/Fill" position on the display 38 to ensure that the display 38 provides the "Off/Fill" indication even when the exit-relative humidity is very low.

The operation of the wick change indicator 16 illustrated in FIGS. 2A, 2B and 3 will now be described. When the humidifier 10 is operating with a good wick 14 and the reservoir 28 is filled with water, the exit-relative humidity of the airflow will be high, generally above the predetermined threshold for indicating a wick change, (e.g., greater than 87%) and the wick change indicator 16 will provide a visual indication that the wick 14 is "good" i.e., the indicating needle 42 of the hygrometer will be positioned in the region designated as "Good" on the display 38 as shown in FIG. 2A. As the performance of the wick 14 deteriorates with use, the exit-relative humidity of the humidifier 10 will also decrease. This will be evident to the user because the indicating needle 42 will move towards a position on the display 3 8 indicating that the wick 14 requires replacement. This position is designated as "Change" on the display 38. When the needle of the hygrometer points to the region "Change" on the display and unit is operating with water in the reservoir, it is time to replace the wick filter 14.

As earlier discussed, the display 38 also provides visual indication should the water level in the reservoir 28 be exhausted such that the exit-relative humidity is low or to indicate that the humidifier 10 is turned "off" and thus the exit-relative humidity would be equal to the ambient humidity. If the wick change indicator 16 is providing an indication that the unit is "off" or "fill", the user will know to check to ensure water is provided in the supply tank 18 and/or that unit has been turned on. Once the tank 18 is filled and the unit turned on, the needle of indicator 16 will move from the "Off/Fill" position to indicate the condition of the filter.

Figure 4:
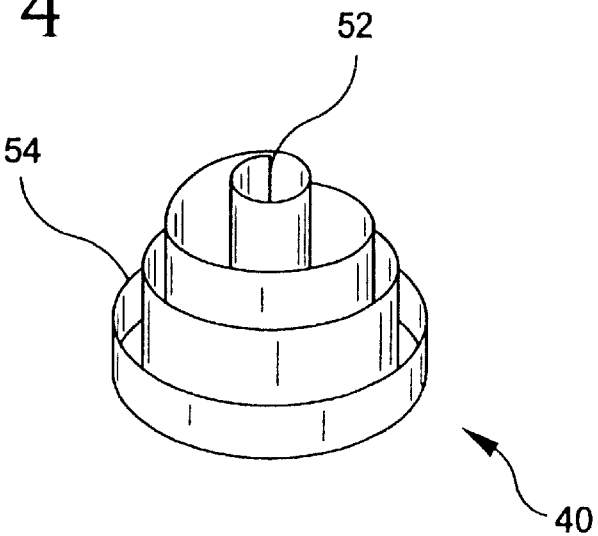
FIG. 4 is a elevational view of a tapered metallic coil that can be used in a preferred embodiment of the present invention shown in FIGS. 2A and 2B.

In an alternative embodiment, the humidity sensitive element 40 is a metallic coil, in which the coil width is tapered from a central end 52 to an external end 54 of the coil as shown in FIG. 4. The tapered width changes the rate of angular displacement of the indicating needle 42 allowing the region over which the display 38 is calibrated to be increased.

Figure 6:
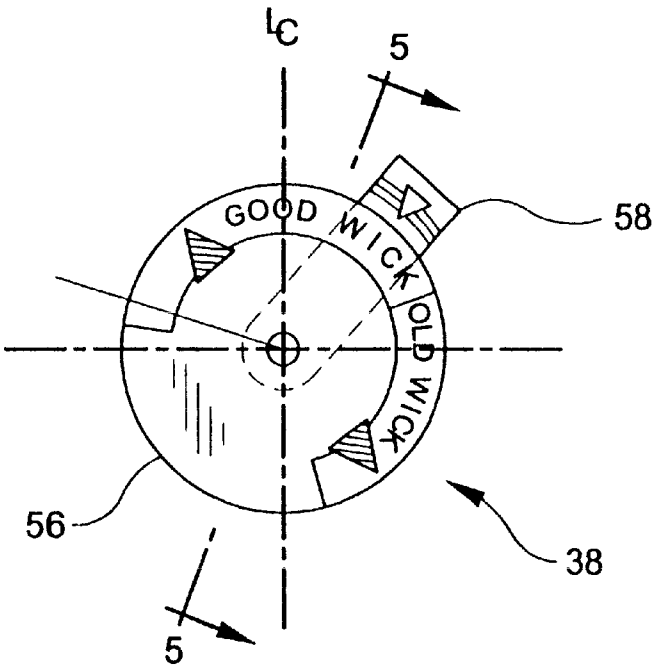
FIG. 6 is a elevational view of a display of an alternative embodiment of the present invention.
Figure 5:
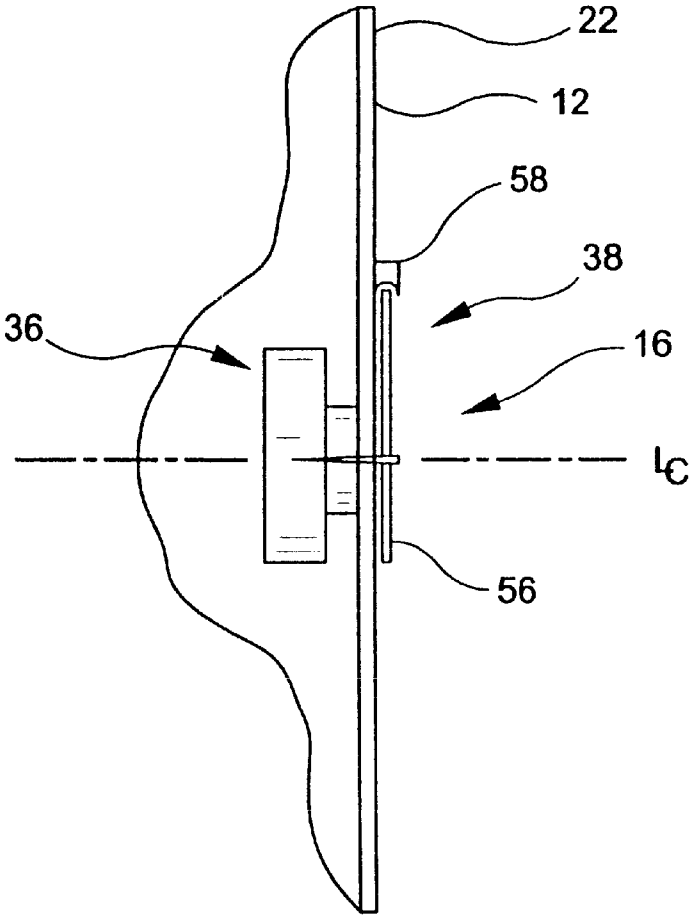
FIG. 5 is a partial cross-sectional view through the upper portion of the housing illustrating an alternative embodiment of the present invention.

Referring now to FIGS. 5 and 6, an alternative embodiment of the present invention also includes a mechanical hygrometer 36 as described above and a display 38. In this embodiment, the display 38 includes a dial 56 that is coupled to the humidity sensitive element 40 and an adjustable pointer 58. As shown in FIG. 6, the dial 56 includes markings for indicating when the wick is good or old and requires replacement. The dial 56 rotates with respect to the pointer 58. The pointer 58 is adjustable by the user to set an initial reading when a new wick is installed. As the performance of the wick deteriorates over time, the dial 56 will rotate based upon sensed exiting relative humidity to indicate when the wick needs replacement.

Figure 7:
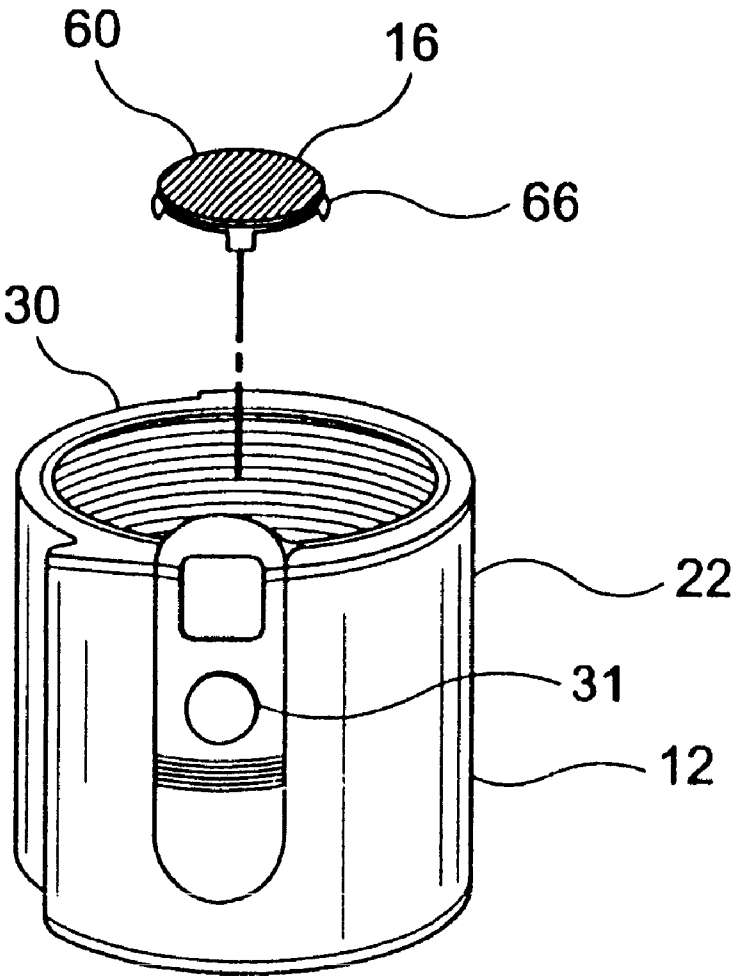
FIG. 7 is a partial exploded view of a preferred embodiment of the present invention that includes a label.
Figure 9:
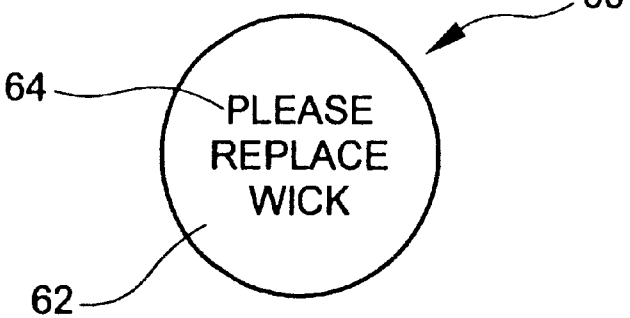
FIG. 9 is a plan view of the label shown in FIG. 7.
Figure 8:
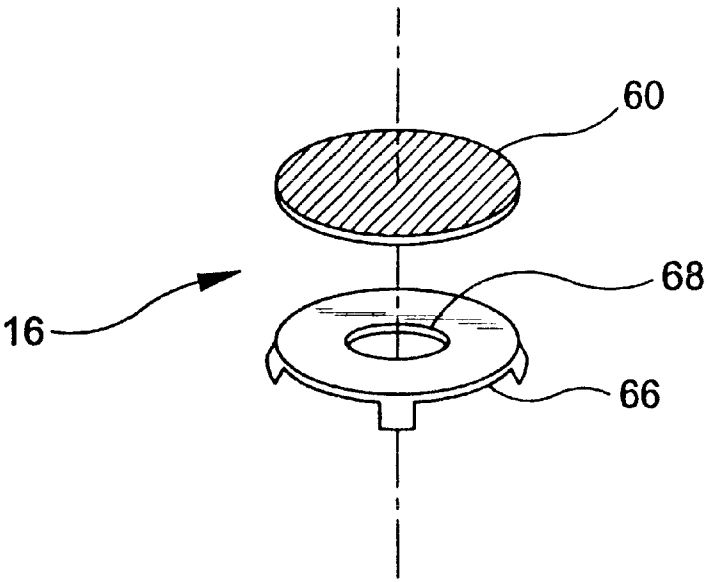
FIG. 8 is a exploded view of the label shown in FIG. 7.

Referring now to FIGS. 7, 8 and 9, a further embodiment of the wick change indicator 16 is a label 60 that is impregnated with a chemical that changes color as a function of humidity. As shown in FIG. 9, the label 60 has a first and second regions 62, 64. The first region 62 is light in color and darkens when the exit-relative humidity of the airflow reaches a first predetermined value. The second region 64 is also light in color and darkens when the exit-relative humidity of the airflow reaches a second predetermined value. Either the first region 62 or the second region 64 define a set of indicia to form the display indicating the wick 14 requires replacement. Preferably the first predetermined value is approximately 87 percent and the second predetermined value is approximately 60 percent. As shown in FIG. 8, the label 60 can be provided with a support plate 66 for attaching the label to the upper portion 22 of the housing 12. The support plate 66 is formed with an opening 68 through its center to ensure that the label makes contact with the exiting airflow. The label 60 can be mounted in the position shown in FIG. 1 for the wick change indicator 16. Preferably the label 60 is mounted in the center of the air outlet 30 as shown in FIG. 7. In an alternative embodiment, the second region is dark in color. In this embodiment the label 60 will indicate that the wick should be replaced when the humidifier 10 is turned off. If the wick 14 is good and the humidifier 10 is turned on, the indication to replace the wick 14 will then disappear.

Figure 11:
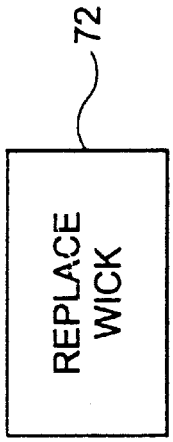
FIG. 11 is a plan view of a liquid crystal display that is used in conjunction with the electrical hygrometer shown in FIG. 10.
Figure 10:
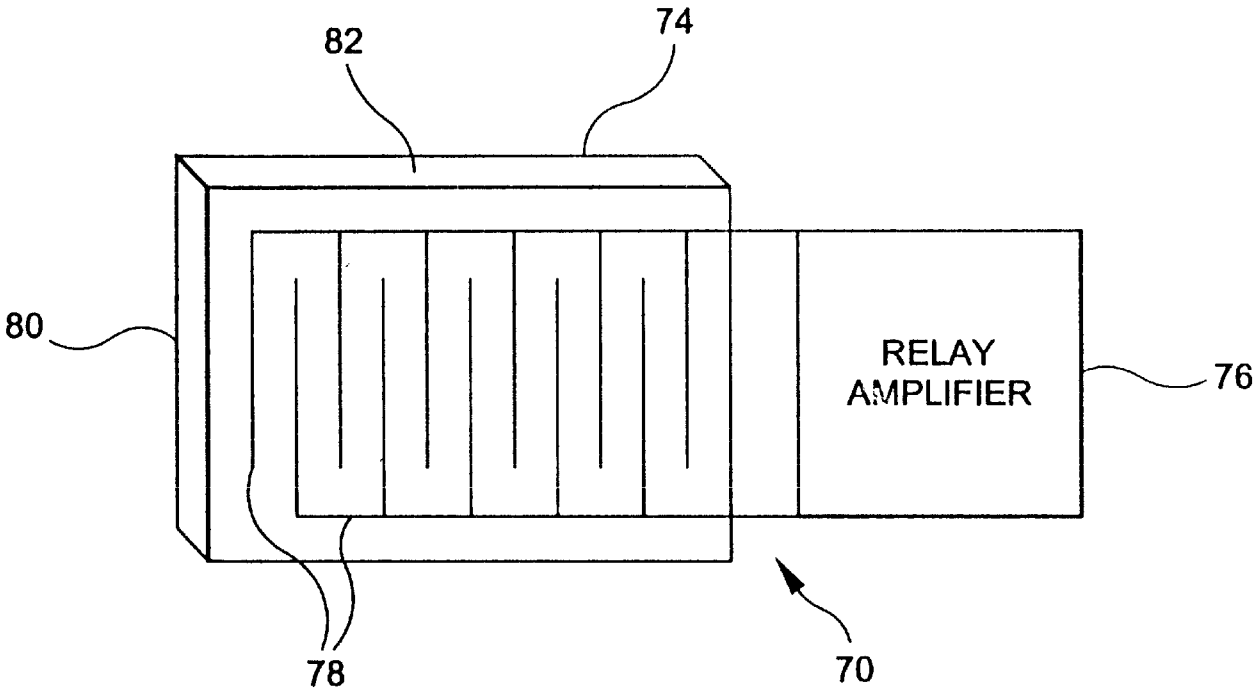
FIG. 10 is a perspective view of an electrical hygrometer formed in accordance with the present invention with an attribute shown schematically.

Referring now to FIGS. 10 and 11, a preferred embodiment of the wick change indicator 16 includes an electrical hygrometer 70 and a liquid crystal display 72. The electrical hygrometer 70 includes a sensing element 74 and a relay amplifier 76. The sensing element 74 has alternate metal conductors 78 on small flat plate 80 with a plastic coating 82. The electrical hygrometer 70 is mounted to the housing 12 within the exiting airflow. The electrical hygrometer 70 is connected to the liquid crystal display 72 and is calibrated to have the display 72 indicate that the wick requires replacement when the exit-relative humidity of the airflow falls below a predetermined humidity.

In the preferred embodiments described with reference to FIGS. 1 through 10, the wick change indicator 16 included only one hygrometer to measure the exit-relative humidity of the airflow generated by the fan 15. In alternative embodiments of the invention, described below the wick change indictor 16 includes a second hygrometer for measuring the ambient-relative humidity, and means for comparing the exit-relative humidity with the ambient-relative humidity for indicating when the wick 14 requires replacement.

Figure 12:
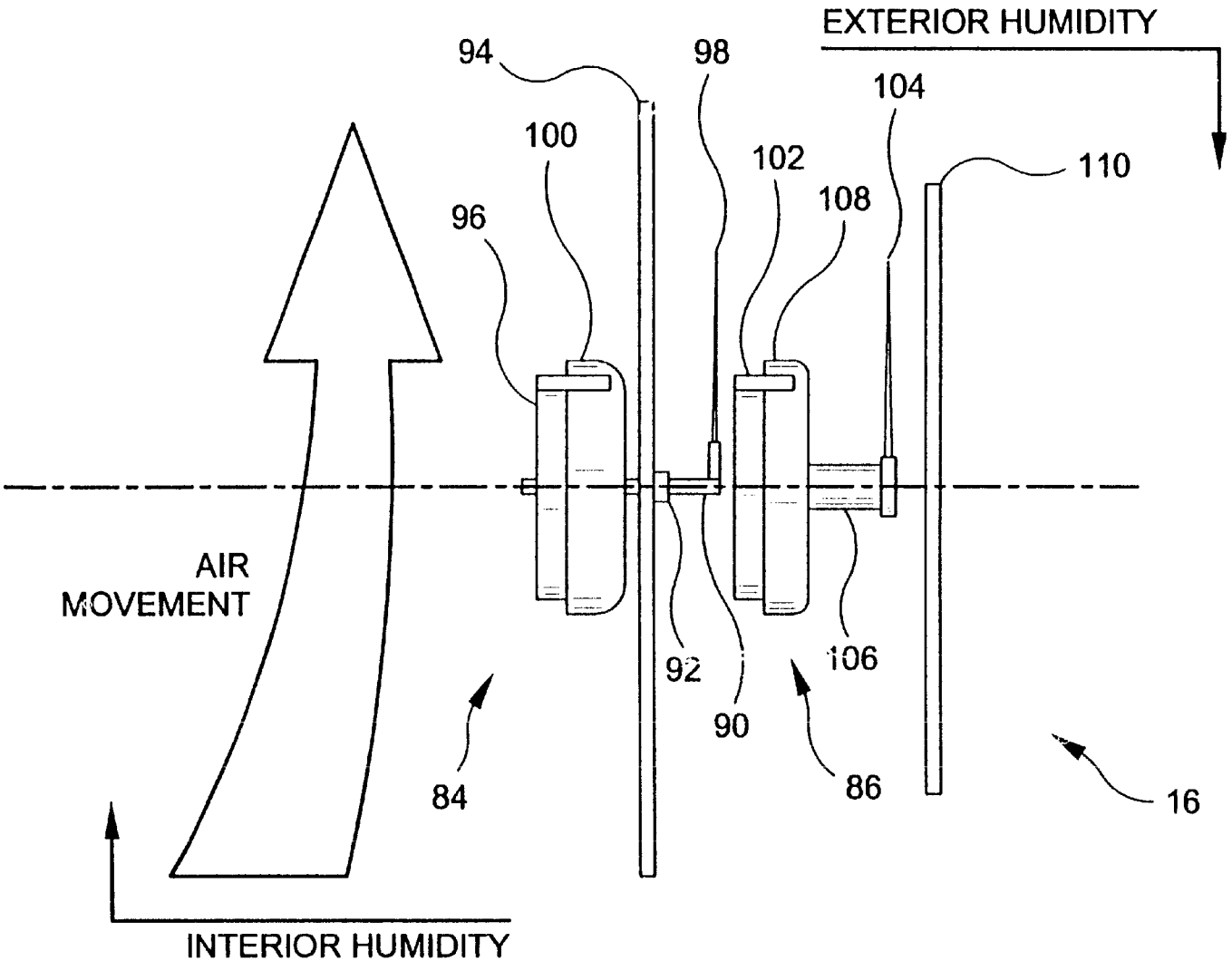
FIG. 12 is a partial cross-sectional view through the upper portion of the housing illustrating an alternative embodiment of the present invention that has a second hygrometer.

Referring now to FIG. 12, a preferred embodiment of a wick change indicator 16 includes first and second hygrometers 84, 86 for forming a display 88 in accordance with the present invention. The first hygrometer 84 is located within the humidifier 10 to measure the exit-relative humidity whereas the second hygrometer 86 is positioned on the exterior of the humidifier 10 to measure the ambient-relative humidity. Both the first and second hygrometers 84, 86 share a shaft 90 that extends through a bearing 92, which is supported by a support plate 94. The support plate 94 can be a separate part that is configured to attach to the housing 12 or it can be integrally formed as part of the housing 12. The first hygrometer 84 has a first humidity sensitive element 96 and a first indicating needle 98 coupled by the shaft 90. Where the first humidity sensitive element 96 is a metallic coil similar to that shown in FIG. 3, a first holder 100 is preferably provided to restrain the free end of the coil. The second hygrometer 86 has a second humidity sensitive element 102 and a second indicating needle 104 coupled by a sleeve 106 that rides the shaft 90 so that both the shaft 90 and sleeve 106 can rotate independently of each other. Similarly where the second humidity sensitive element 96 is a metallic coil, a second holder 108 is preferably provided to restrain the other end of the coil. The first indicating needle 98 and the second indicating needle 104 form the display 88 for providing an indication that the wick 14 requires replacement. Preferably the wick change indicator 16 is provided with a window 110 for protection.

Figure 14:
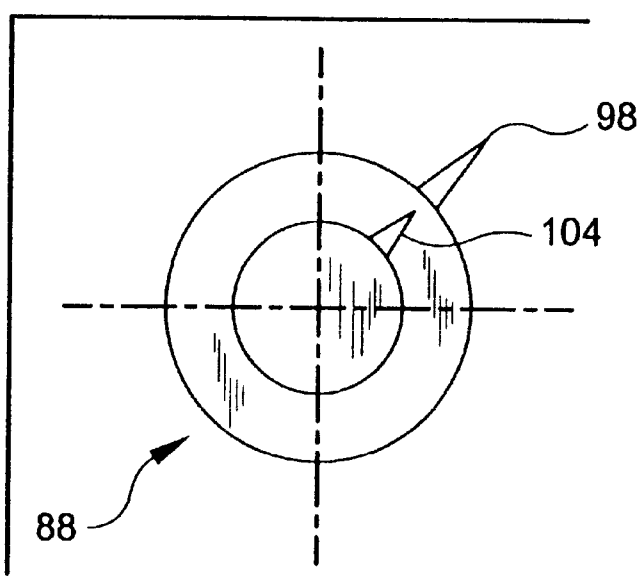
FIG. 14 is a view of the display of the embodiment of the invention shown in FIG. 12 when the humidifier is off and the ambient-relative humidity is high.
Figure 13:
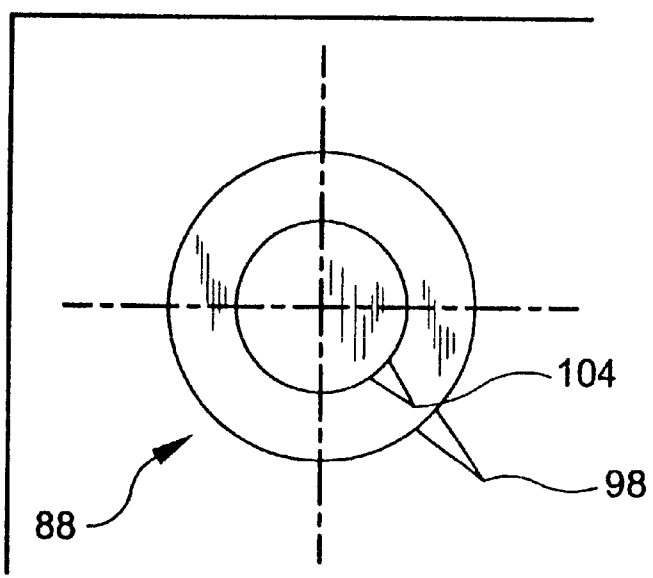
FIG. 13 is a view of the display of the embodiment of the invention shown in FIG. 12 when the humidifier is off and the ambient-relative humidity is low.
Figure 16:
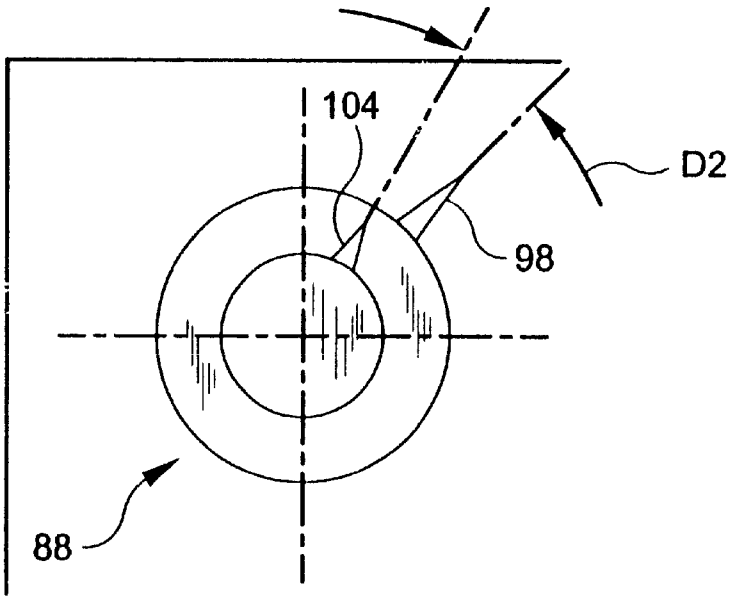
FIG. 16 is a view of the display of the embodiment of the invention shown in FIG. 12 when the humidifier is on, the ambient-relative humidity is high, and the wick is good.
Figure 15:
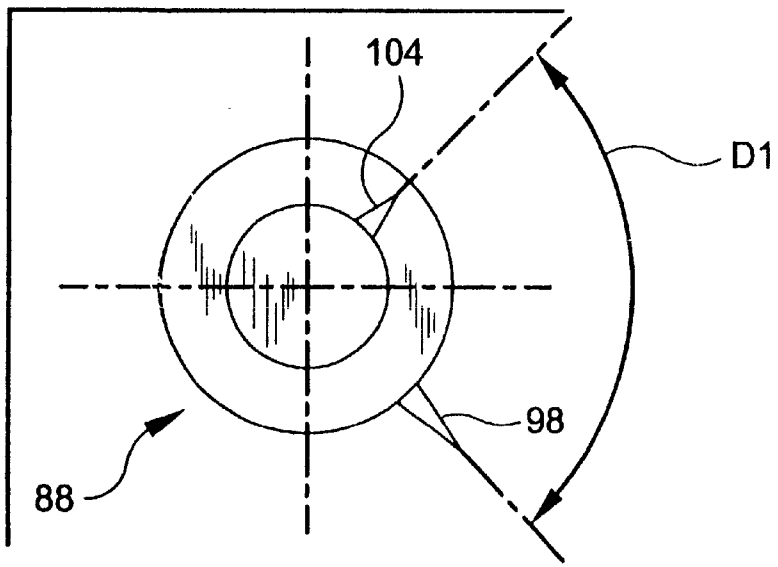
FIG. 15 is a view of the display of the embodiment of the invention shown in FIG. 12 when the humidifier is on, the ambient-relative humidity is low, and the wick is good.
Figure 17:
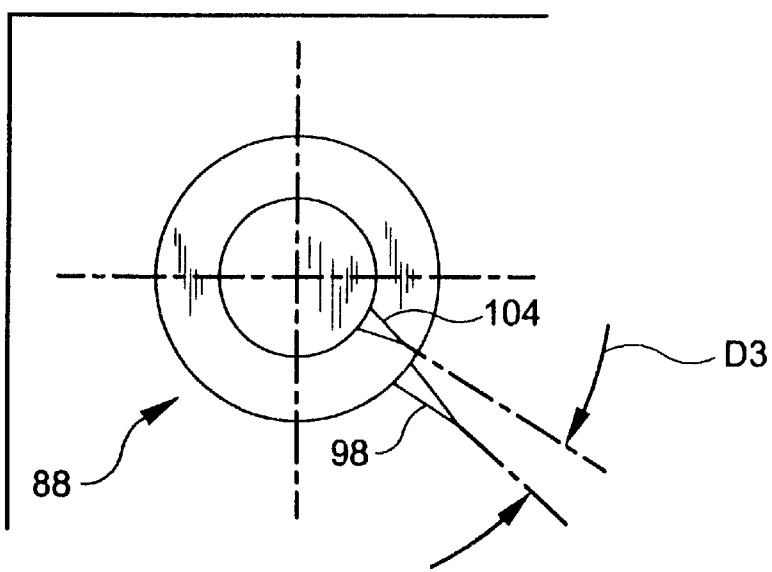
FIG. 17 is a view of the display of the embodiment of the invention shown in FIG. 12 when the humidifier is on, the ambient-relative humidity is low, and the wick is bad.

Referring now to FIGS. 13 through 18, the operation of the wick change indicator 16 shown in FIG. 12 will be explained. When the unit is off and not working, the humidity inside the humidifier will be substantially identical to the ambient-relative humidity outside of the humidifier. Thus both the first and second hygrometers 84, 86 would indicate the same reading whether the ambient-relative humidity is low or high as shown in FIGS. 13 and 14 respectively. However, when the ambient-relative humidity is low, a good wick 14 installed in the humidifier 10, and the humidifier 10 is turned on, there is a large difference, D1, between the ambient-relative humidity and the exit-relative humidity values as shown in FIG. 15. This is because a good wick will be saturated with water and create a high exit-relative humidity value. This difference is thus a measure of the wick 14 condition. A large difference between the first and second hygrometers 84, 86 indicates that the wick 14 is good and functioning well. Similarly a small difference generally indicates that the wick 14 is bad and needs to be replaced as shown in FIG. 17.

Figure 18:
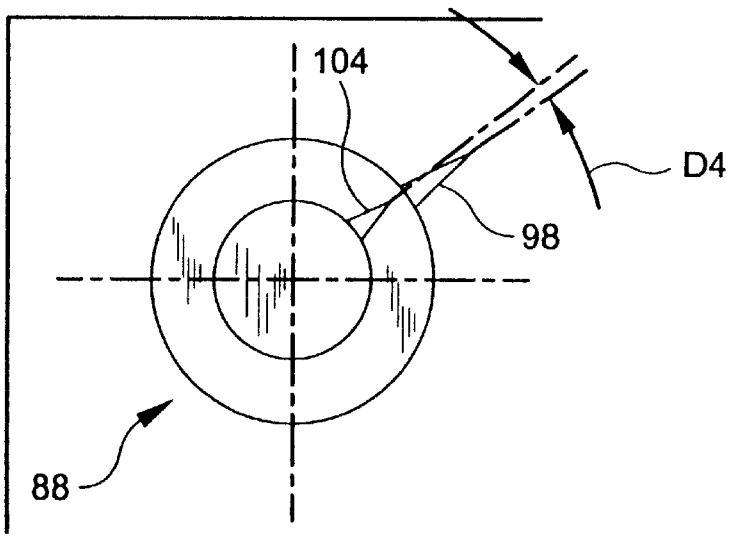
FIG. 18 is a view of the display of the embodiment of the invention shown in FIG. 12 when the humidifier is on, the ambient-relative humidity is high, and the wick is bad.

Referring now to FIGS. 16 and 18, when the ambient-relative humidity is already high, it is difficult to determine whether the wick 14 needs to be replaced. This is due to the fact that the efficiency of the humidifier 10 decreases exponentially as a function of the ambient-relative humidity. Thus, a dry room will be easier to humidify than a humid room. Thus the wick change indicator 16, at this condition cannot tell the difference between a good or a bad wick. This problem can be overcome through use of appropriate user instructions.

Figure 19:
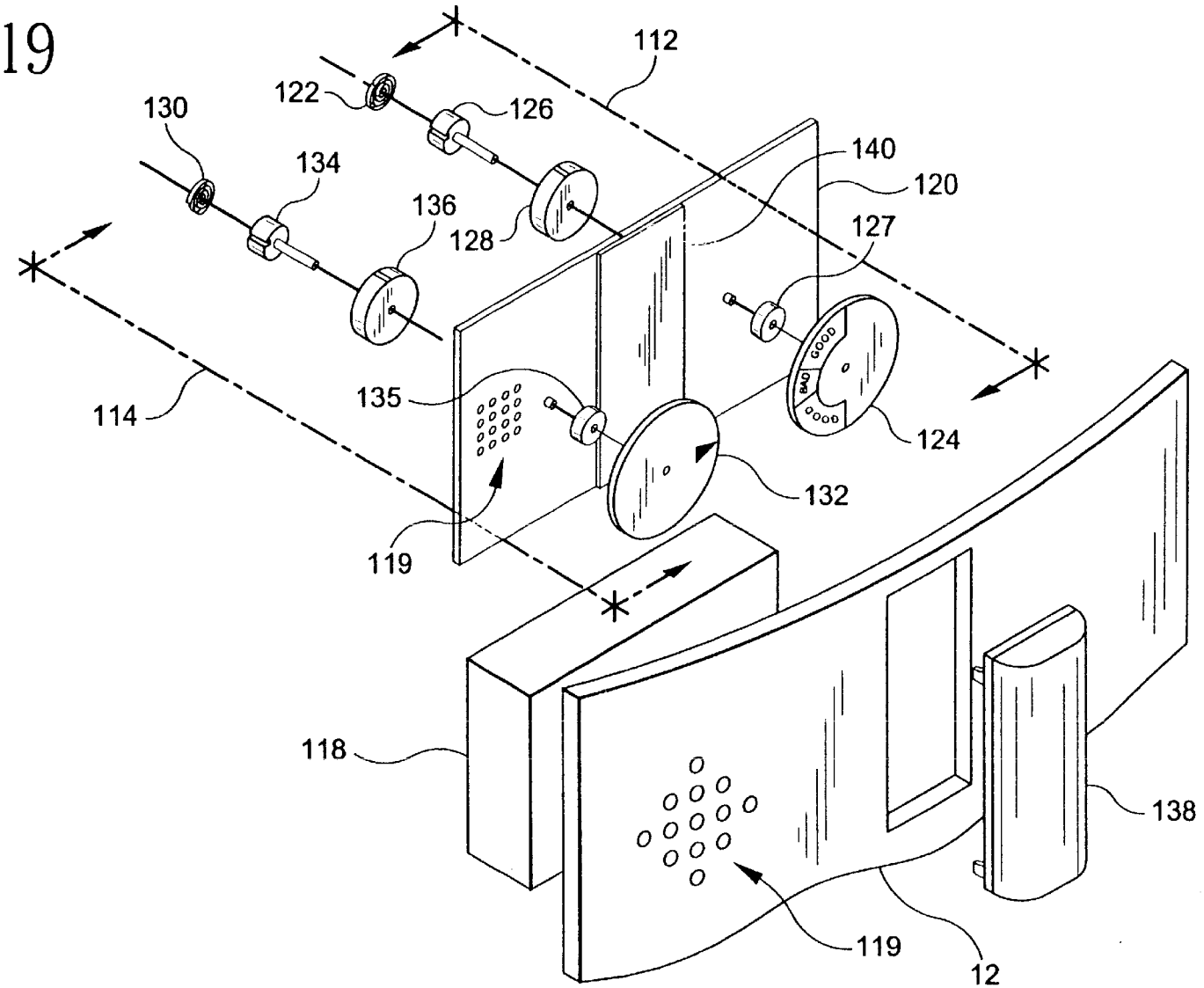
FIG. 19 is an exploded view of the upper portion of the housing illustrating an alternative embodiment of the present invention that has a second hygrometer.
Figure 27:
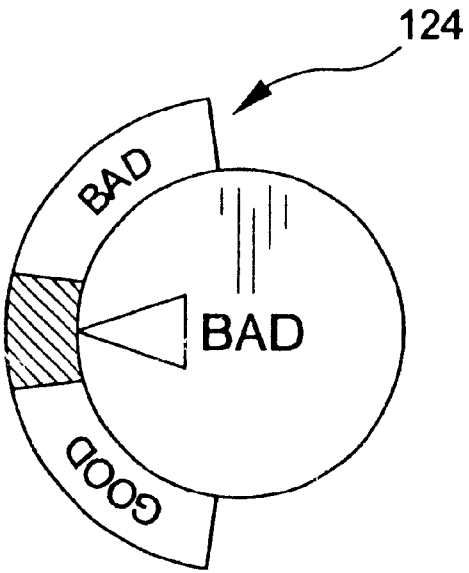
FIG. 27 illustrates the graphic details for the first indicating disk for forming the display of the embodiment of the invention shown in FIG. 19.
Figure 26:
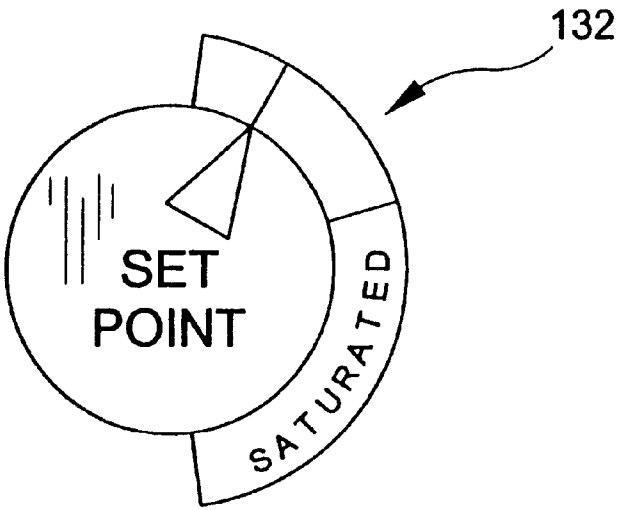
FIG. 26 illustrates the graphic details for the second indicating disk for forming the display of the embodiment of the invention shown in FIG. 19.

Referring now to FIG. 19, a preferred embodiment of a wick change indicator 16 includes first and second hygrometers 112, 114 adjacently arranged for forming a display 116 in accordance with the present invention. The first hygrometer 112 is located within the humidifier 10 to measure the exit-relative humidity. Preferably the second hygrometer 114 is also located within the humidifier 10, but is provided with an isolation housing 118 that includes openings 119 to measure the ambient-relative humidity. Preferably both the first and second hygrometers 112, 114 share a support plate 120 that can be either a separate part that is configured to attach to the housing 12 or it can be integrally formed as part of the housing 12. The first hygrometer 112 has a first humidity sensitive element 122 and a first indicating disk 124 coupled by a first shaft 126 that extends through a bearing 127, which is supported by the support plate 120. Where the first humidity sensitive element 122 is a metallic coil similar to that shown in FIG. 3, a first holder 128 is preferably provided to restrain the free end of the coil. The second hygrometer 114 has a second humidity sensitive element 130 and a second indicating disk 132 coupled by a second shaft 134 that extends through a bearing 135, which is supported by the support plate 120. Similarly, where the second humidity sensitive element 122 is a metallic coil, a second holder 136 is preferably provided to restrain the free end of the coil. Further, when metallic coils are used for both the first humidity sensitive element 122 and the second humidity sensitive element 130, one of the coils is arranged in a clockwise manner with the other in a counter clockwise manner. Referring now to FIGS. 26 and 27, the first indicating disk 124 and the second indicating disk 132 are each provided with graphic details to form the display 116 to provide an indication that the wick 14 requires replacement. Preferably the wick change indicator 16 is provided with a window 138 for protection and a reflective background 140.

Figure 21:
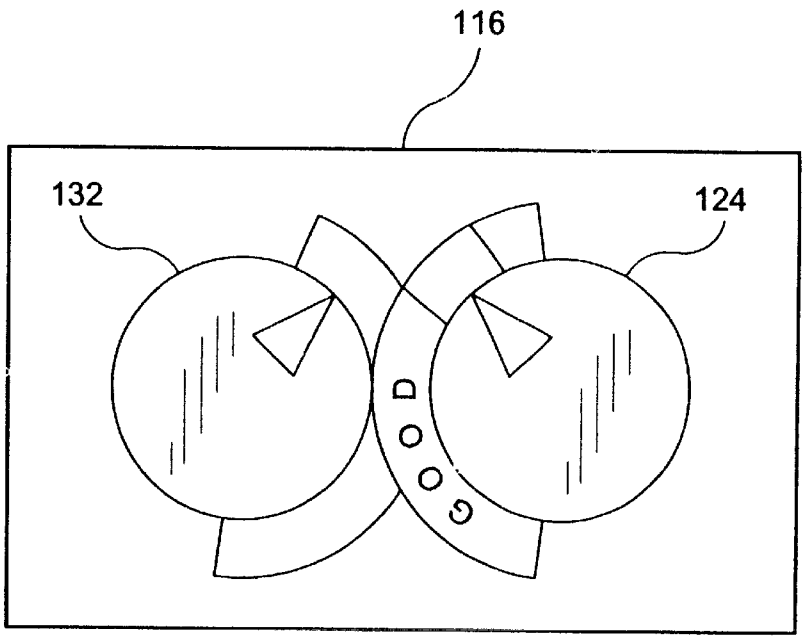
FIG. 21 is a view of the display of the embodiment of the invention shown in FIG. 19 when the humidifier is off and the ambient-relative humidity is high.
Figure 20:
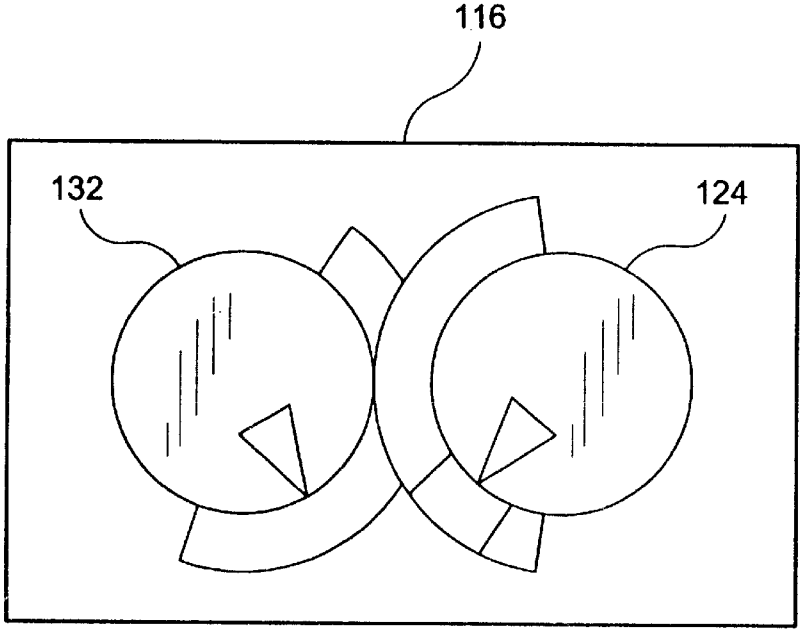
FIG. 20 is a view of the display of the embodiment of the invention shown in FIG. 19 when the humidifier is off and the ambient-relative humidity is low.
Figure 23:
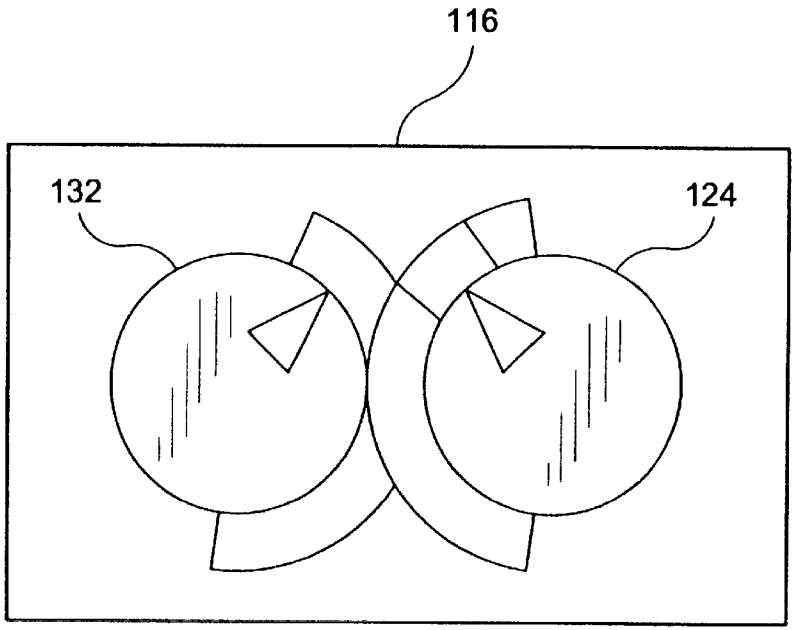
FIG. 23 is a view of the display of the embodiment of the invention shown in FIG. 19 when the humidifier is on, the ambient-relative humidity is high, and the wick is good.
Figure 22:
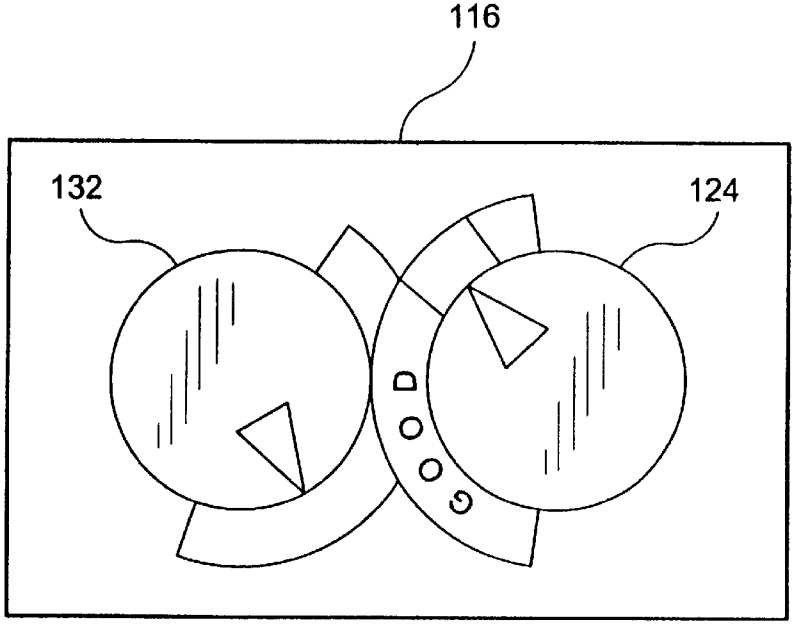
FIG. 22 is a view of the display of the embodiment of the invention shown in FIG. 19 when the humidifier is on, the ambient-relative humidity is low, and the wick is good.
Figure 24:
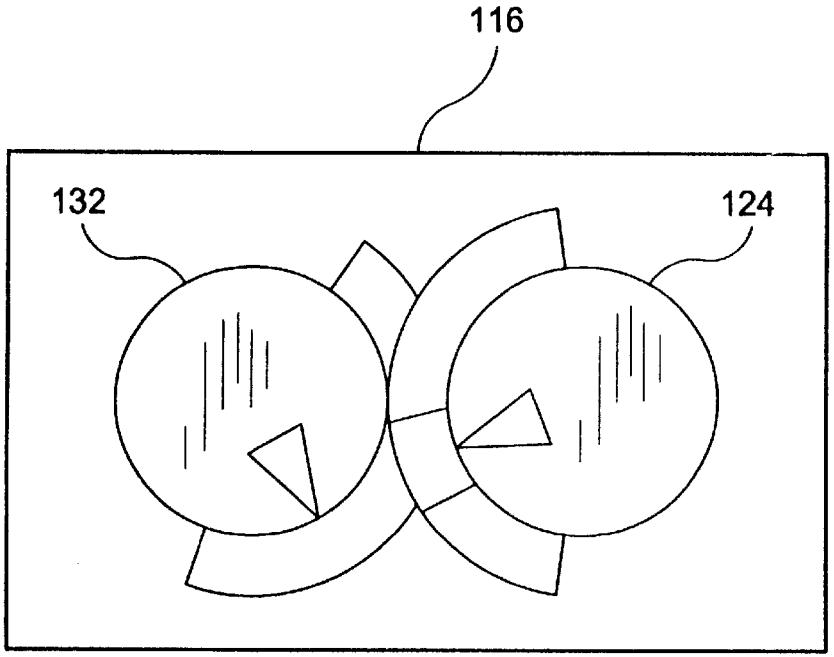
FIG. 24 is a view of the display of the embodiment of the invention shown in FIG. 19 when the humidifier is on, the ambient-relative humidity is low, and the wick is bad.

Referring now to FIGS. 20 through 25, the operation of the wick change indicator 16 shown in FIG. 19 will be explained. When the unit is off and not working, the humidity inside the humidifier will be substantially identical to the ambient-relative humidity outside of the humidifier 10. Thus, both the first and second hygrometers 112, 114 would indicate the same reading whether the ambient-relative humidity is low or high as shown in FIGS. 20 and 21 respectively. However, when the ambient-relative humidity is low, a good wick 14 installed in the humidifier 10, and the humidifier 10 is turned on, there is a large difference between the ambient-relative humidity and the exit-relative humidity values as shown in FIG. 22. This is because a good wick will be saturated with water and create a high exit-relative humidity value. This difference is thus a measure of the wick 14 condition. A large difference between the first and second hygrometers 112, 114 indicates that the wick 14 is good and functioning well. Similarly a small difference generally indicates that the wick 14 is bad and needs to be replaced as shown in FIG. 24.

Figure 25:
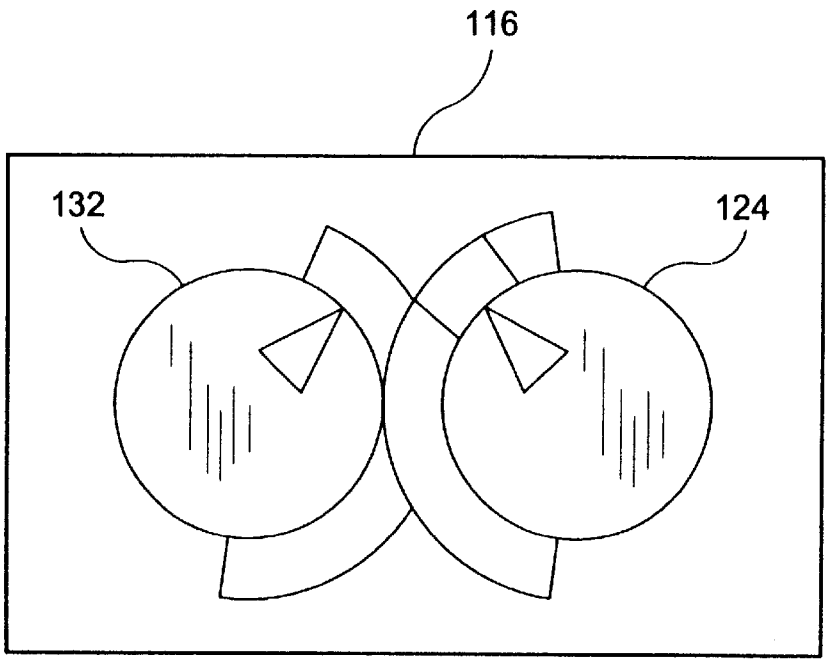
FIG. 25 is a view of the display of the embodiment of the invention shown in FIG. 19 when the humidifier is on, the ambient-relative humidity is high, and the wick is bad.

Referring now to FIGS. 23 and 25, when the ambient-relative humidity is already high, it is difficult to determine whether the wick 14 needs to be replaced for the same reasons described above with regard to the embodiment depicted in FIG. 12. Again this problem can be overcome through use of appropriate user instructions.

Figure 28:
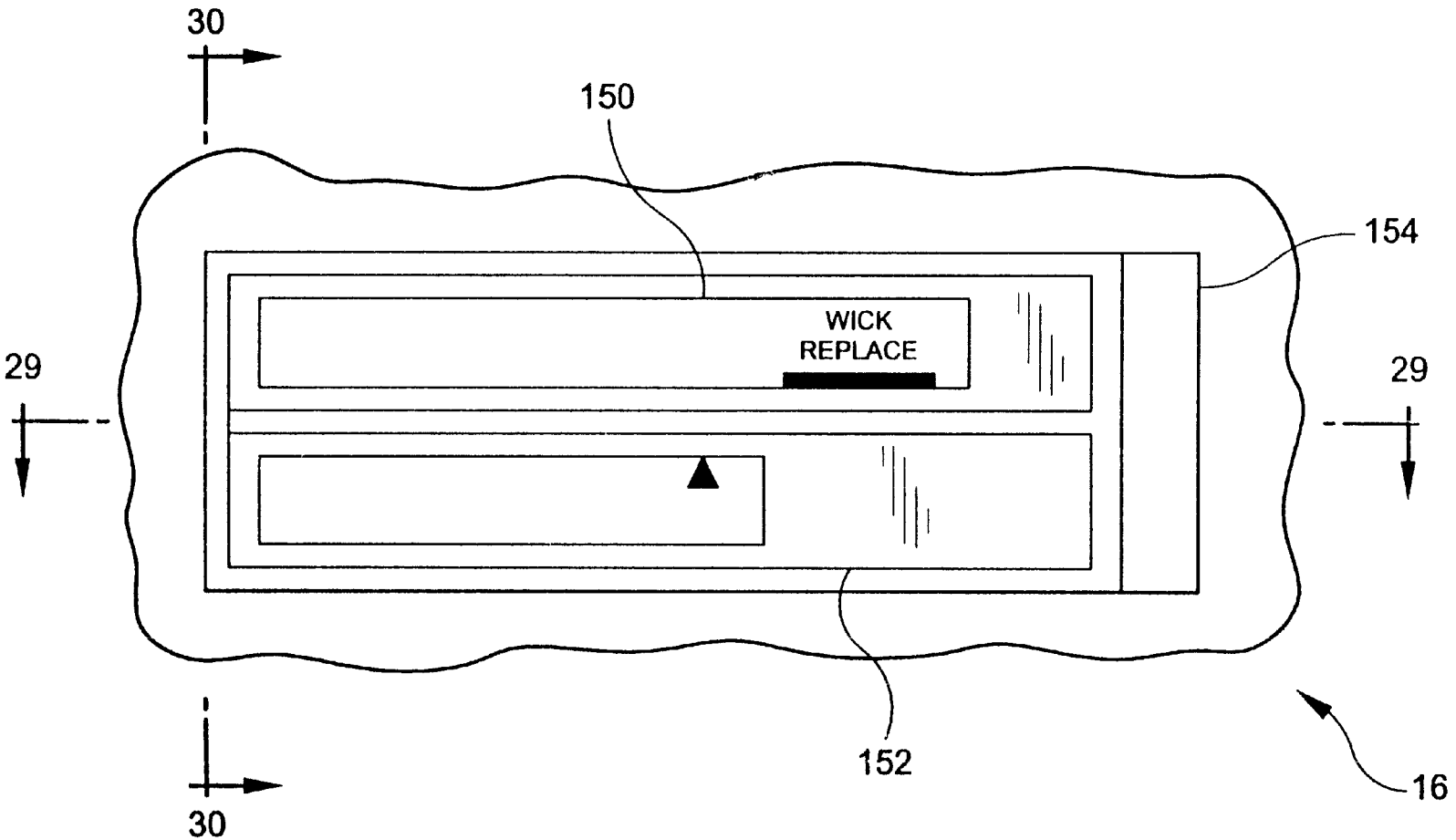
FIG. 28 is a view of a display of an alternative embodiment of the present invention that has a second hygrometer.
Figure 29:
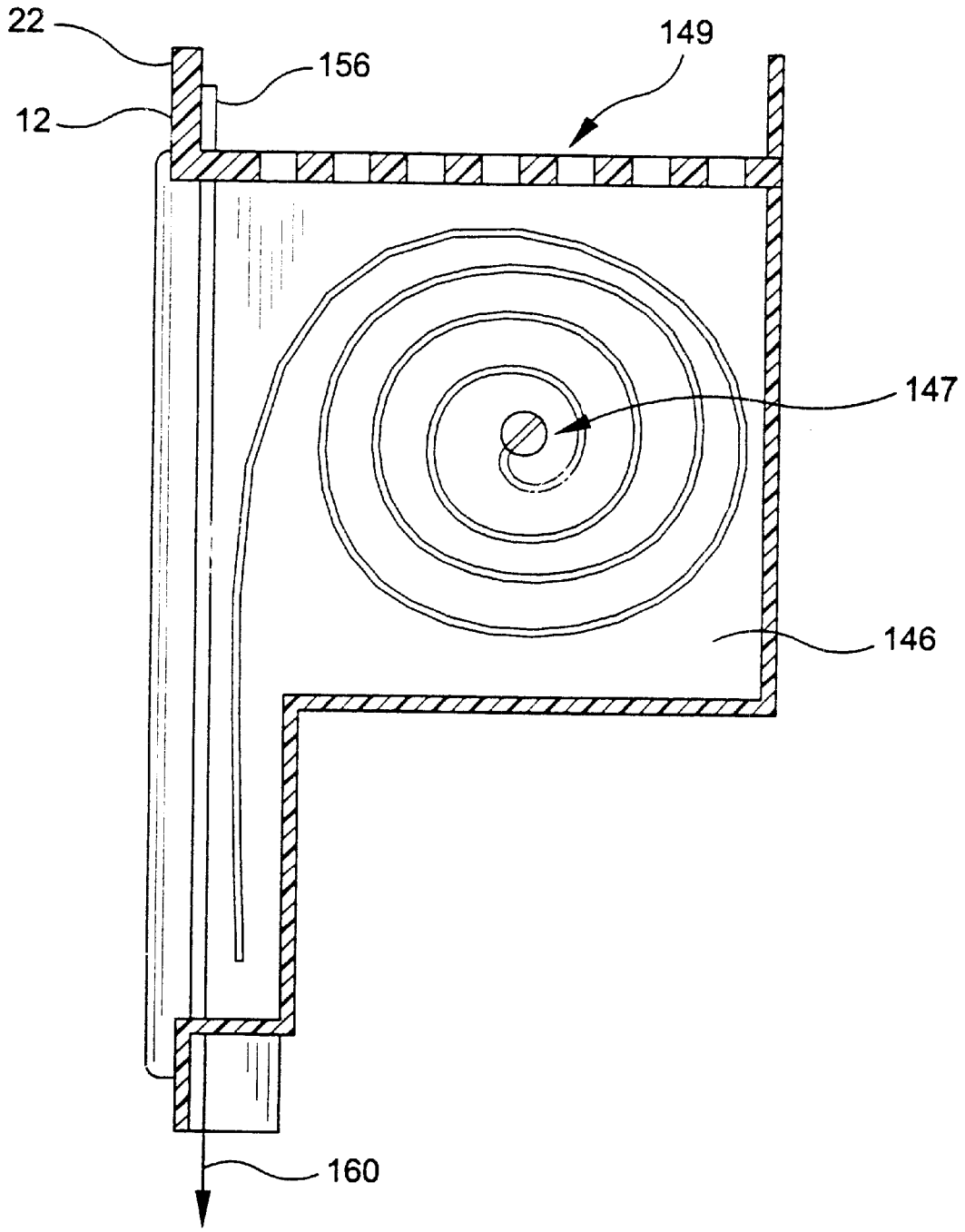
FIG. 29 is a cross-sectional view through the embodiment of the invention shown in FIG. 28.
Figure 31:
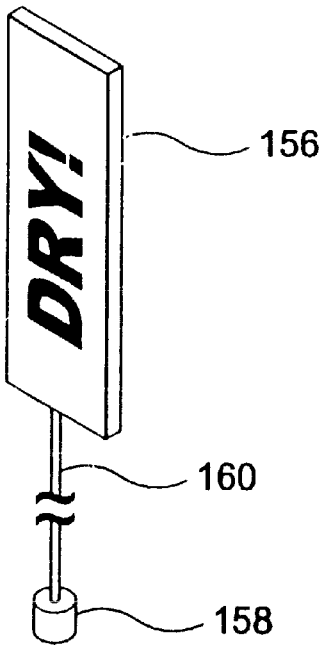
FIG. 31 is an isolated view of the shade configuration.
Figure 30:
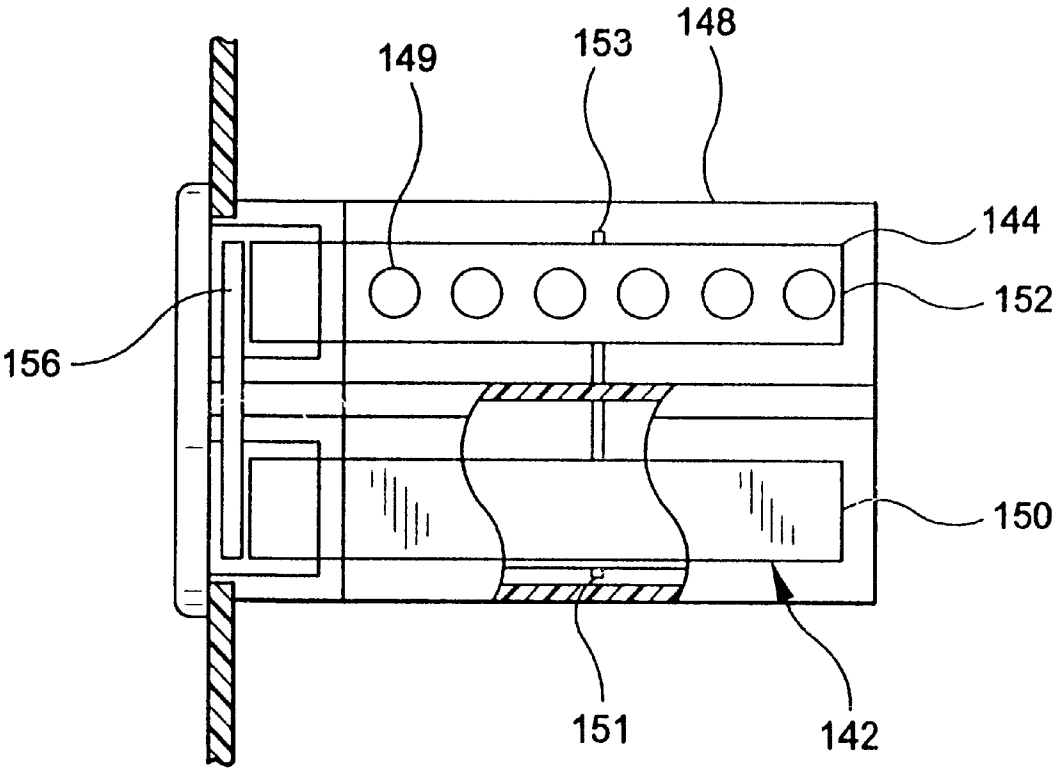
FIG. 30 is a partial cross-sectional view through the embodiment of the invention shown in FIG. 28.
Figure 32:
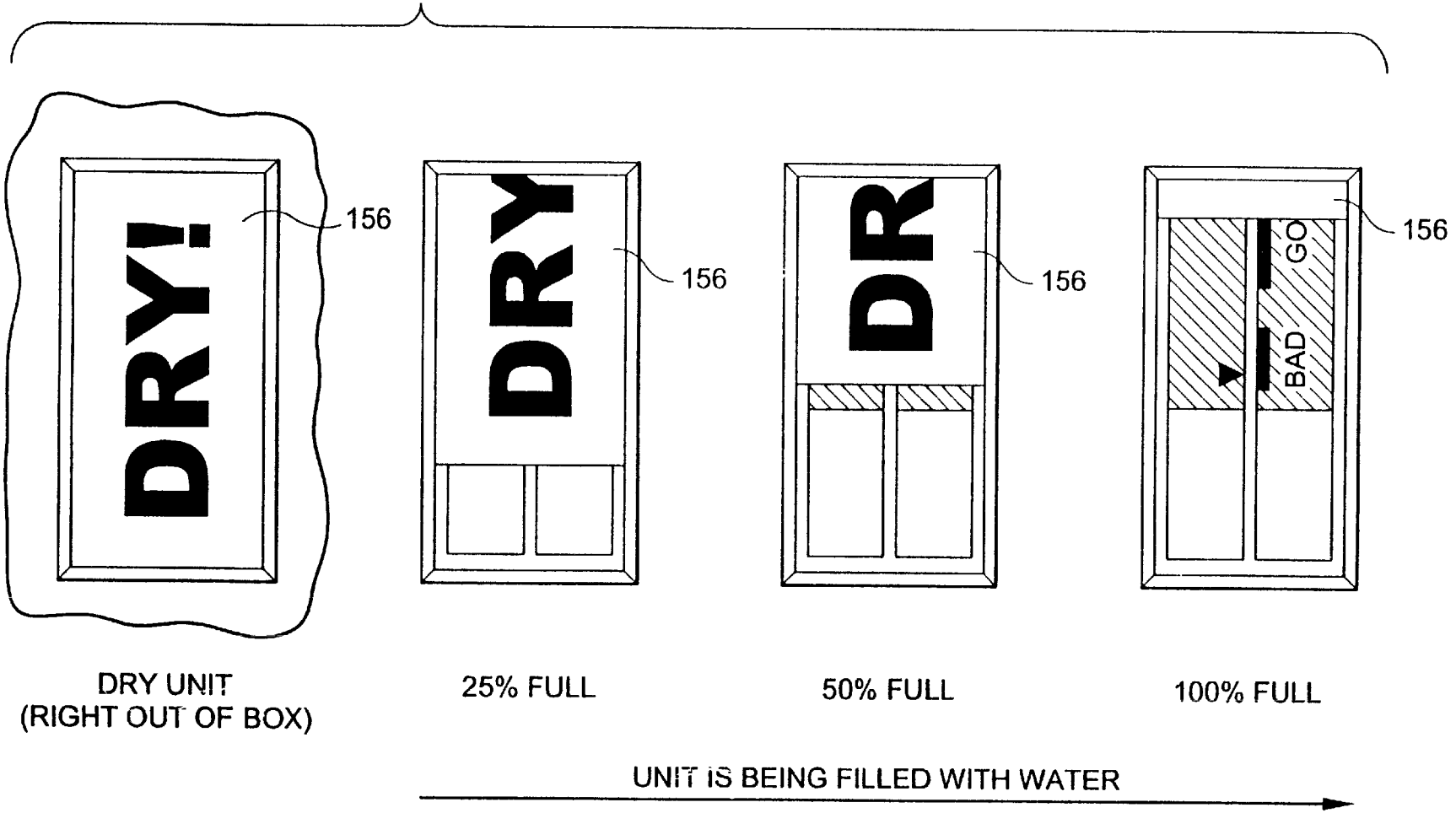
FIG. 32 is a view illustrating the operation of the shade at various reservoir levels.

Referring now to FIGS. 28, 29, and 30, another embodiment of a wick change indicator 16 includes first and second hygrometers 142, 144 adjacently arranged for forming a display 154 in accordance with the present invention. Both the first and second hygrometers 142, 144 share a support plate 146 and a fixed shaft 147. The fixed shaft 147 extends through the support plate 146 having a first end 151 and a second end 153 extending from opposite sides of the support plate. The first hygrometer 142 is located within the humidifier 10 to measure the exit-relative humidity. Preferably the second hygrometer 144 is also located within the humidifier 10, but is provided with an isolation housing 148 that includes openings 149 to allow the second hygrometer 144 to measure the ambient-relative humidity. The first hygrometer 142 has a first humidity sensitive element 150 that is attached to the first end 151 of the fixed shaft 147. Similarly the second hygrometer 144 has a second humidity sensitive element 152 that is attached to the second end 153 of the fixed shaft 147. Preferably the first and second humidity sensitive elements 150, 152 are metallic coils provided with graphic details at their free ends to form a display 154 as shown in FIG. 28. Preferably the wick change indicator 16 also includes a shade 156 that is attached to a float 158 through a link 160 to provide an indication as to whether there is water in the reservoir 28 of the humidifier 10. When the humidifier is completely dry, the float 158 and the shade 156 will be fully seated. As the reservoir is filled with water the float 158 lifts the shade 156 as shown in FIG. 32.

Figure 34:
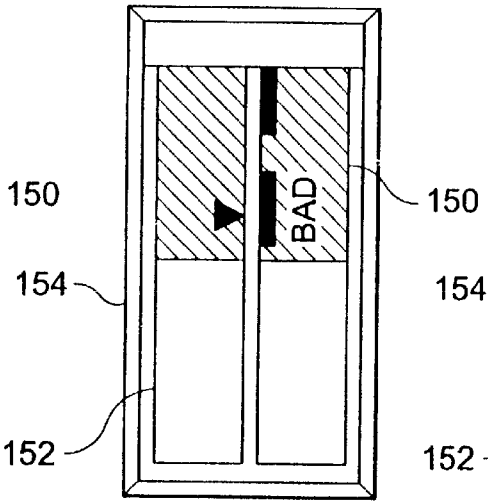
FIG. 34 is a view of the display of the embodiment of the invention shown in FIG. 28 when the humidifier is on, the ambient-relative humidity is low, and the wick is bad.
Figure 33:
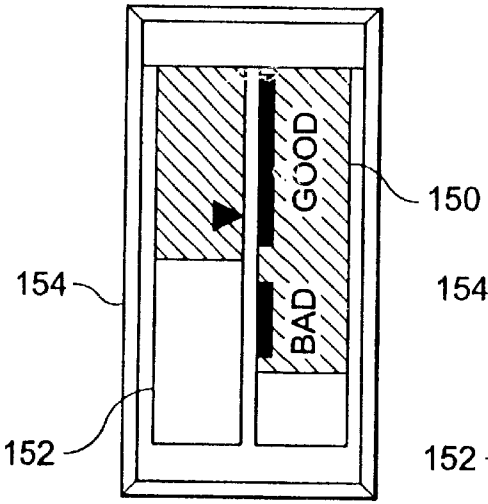
FIG. 33 is a view of the display of the embodiment of the invention shown in FIG. 28 when the humidifier is on, the ambient-relative humidity is low, and the wick is good.
Figure 37:
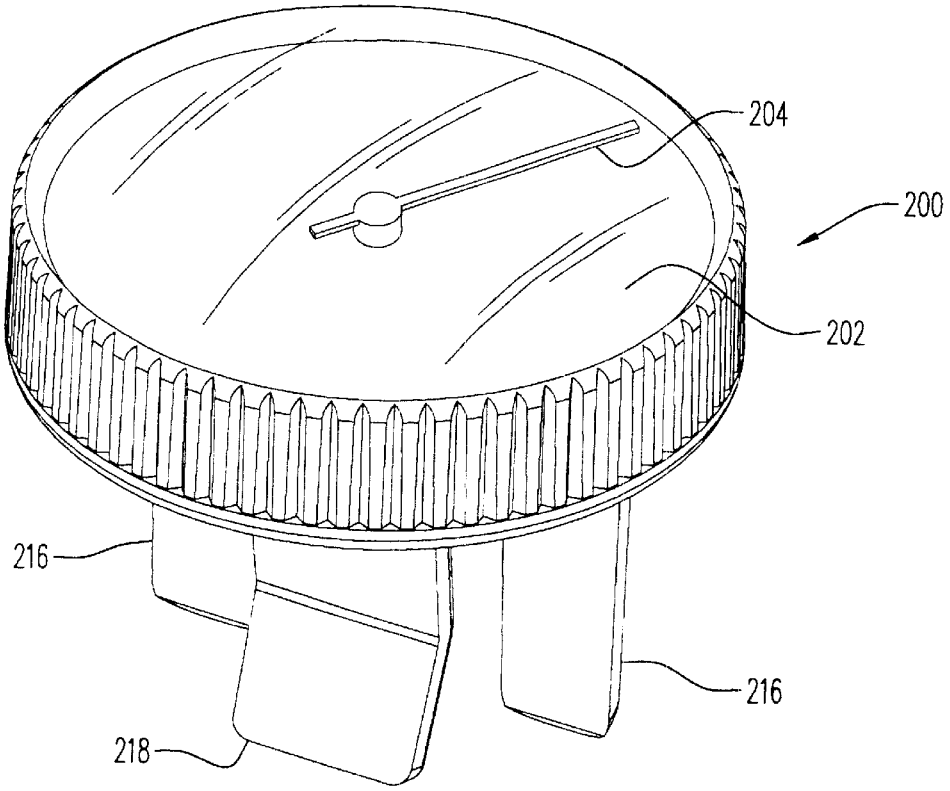
FIG. 37 is a perspective view of a removable humidifier performance indicator formed in accordance with the present invention.
Figure 38:
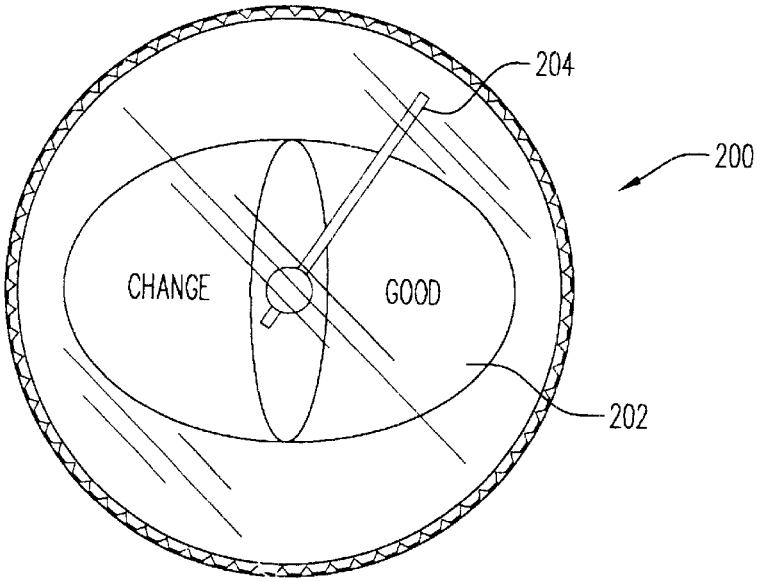
FIG. 38 is a top view of the performance indicator shown in FIG. 37.
Figure 39:
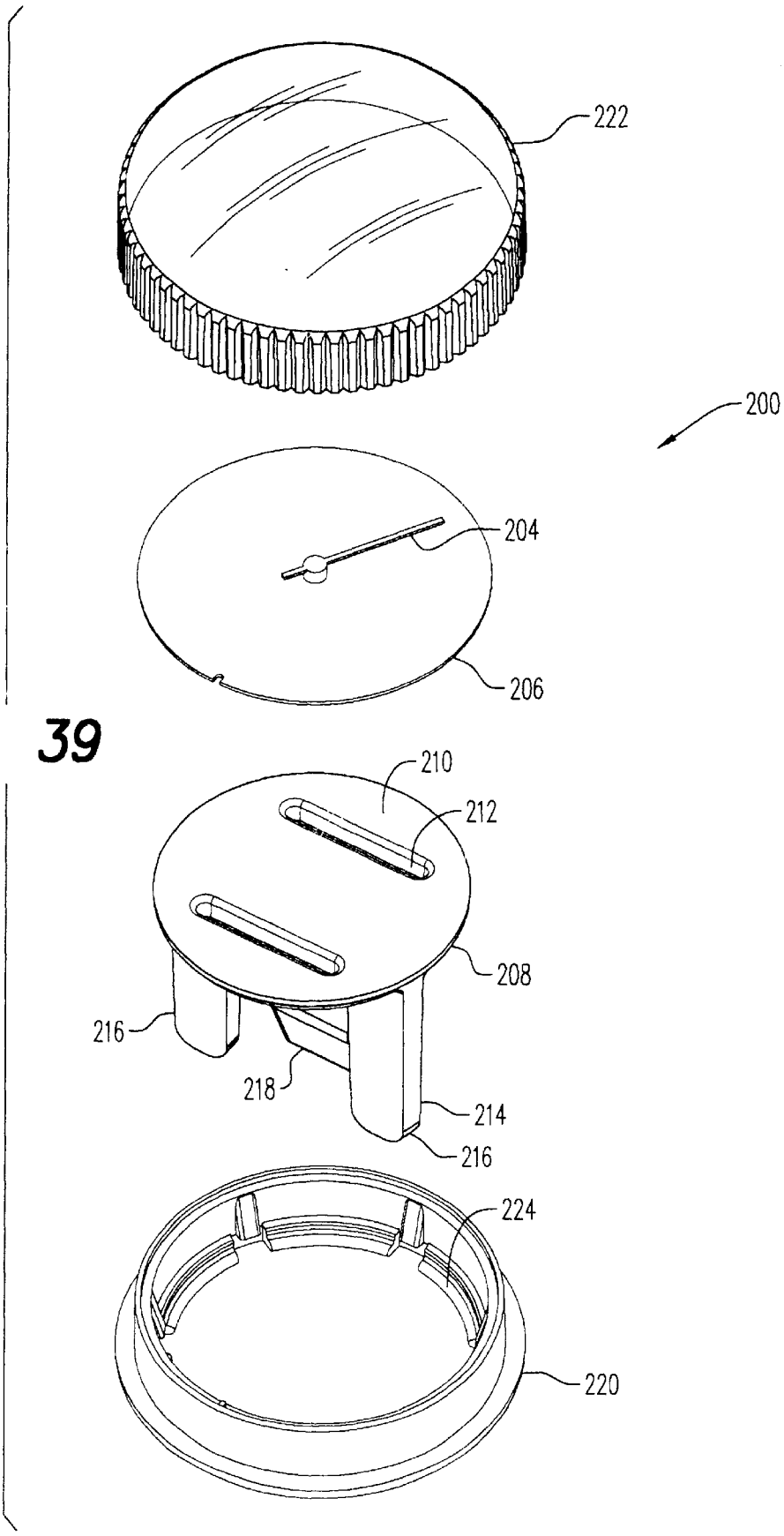
FIG. 39 is an exploded view of the performance indicator shown in FIG. 37.
Figure 40:
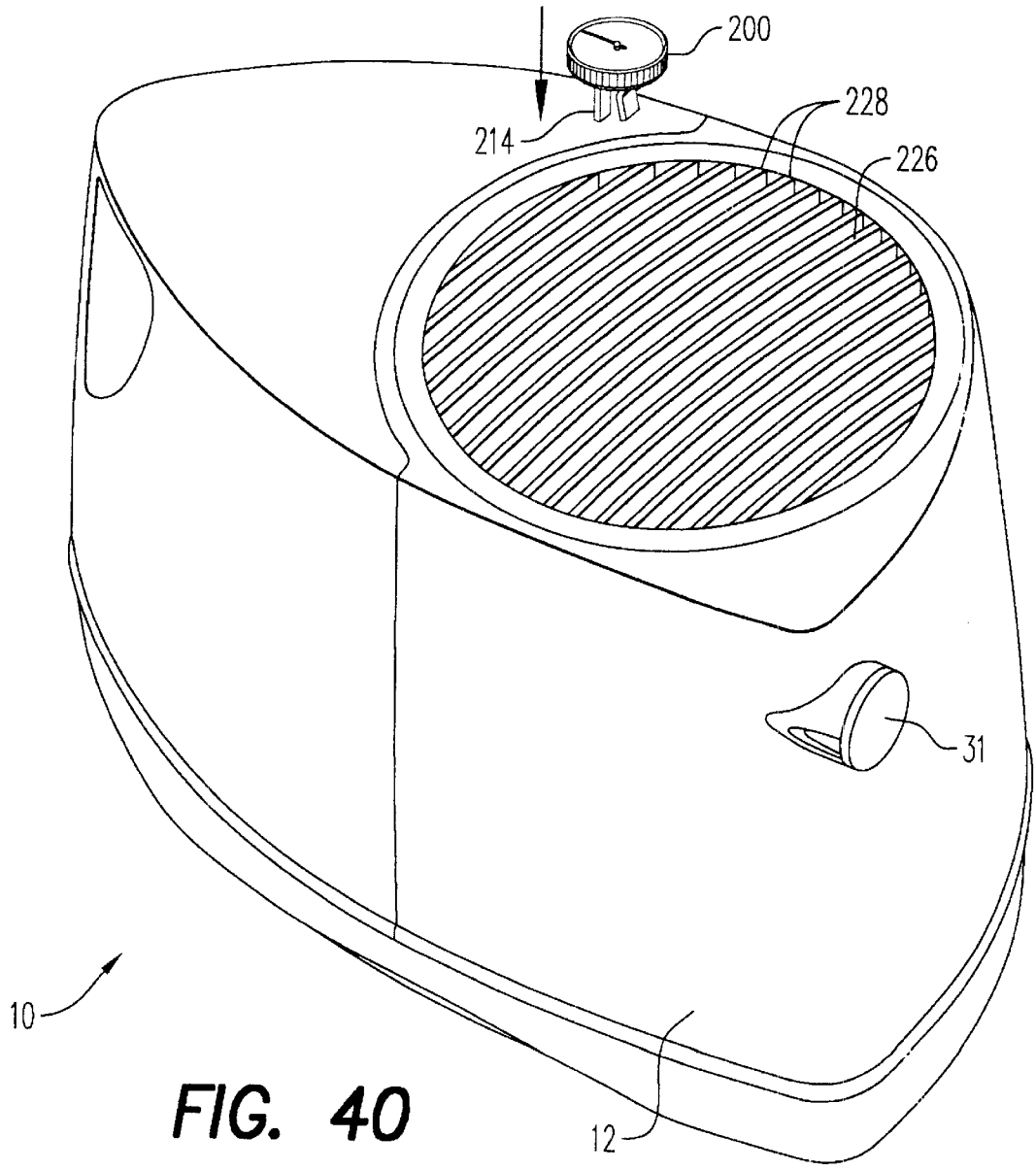
FIG. 40 is a perspective view of the performance indicator shown in FIG. 37 being attached to a humidifier.
Figure 41:
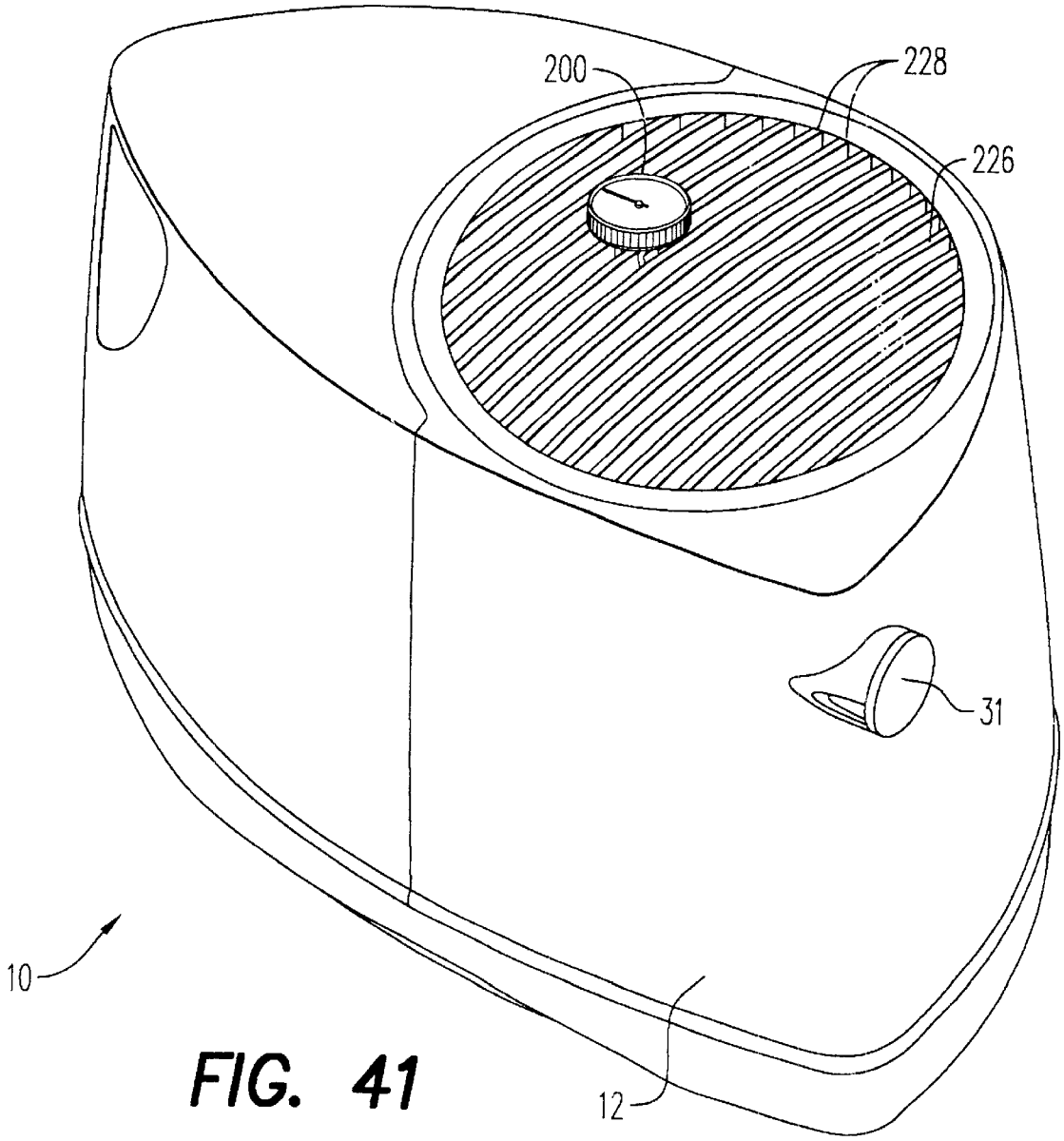
FIG. 41 is a perspective view of the performance indicator shown in FIG. 37 attached to a humidifier.
Figure 42:
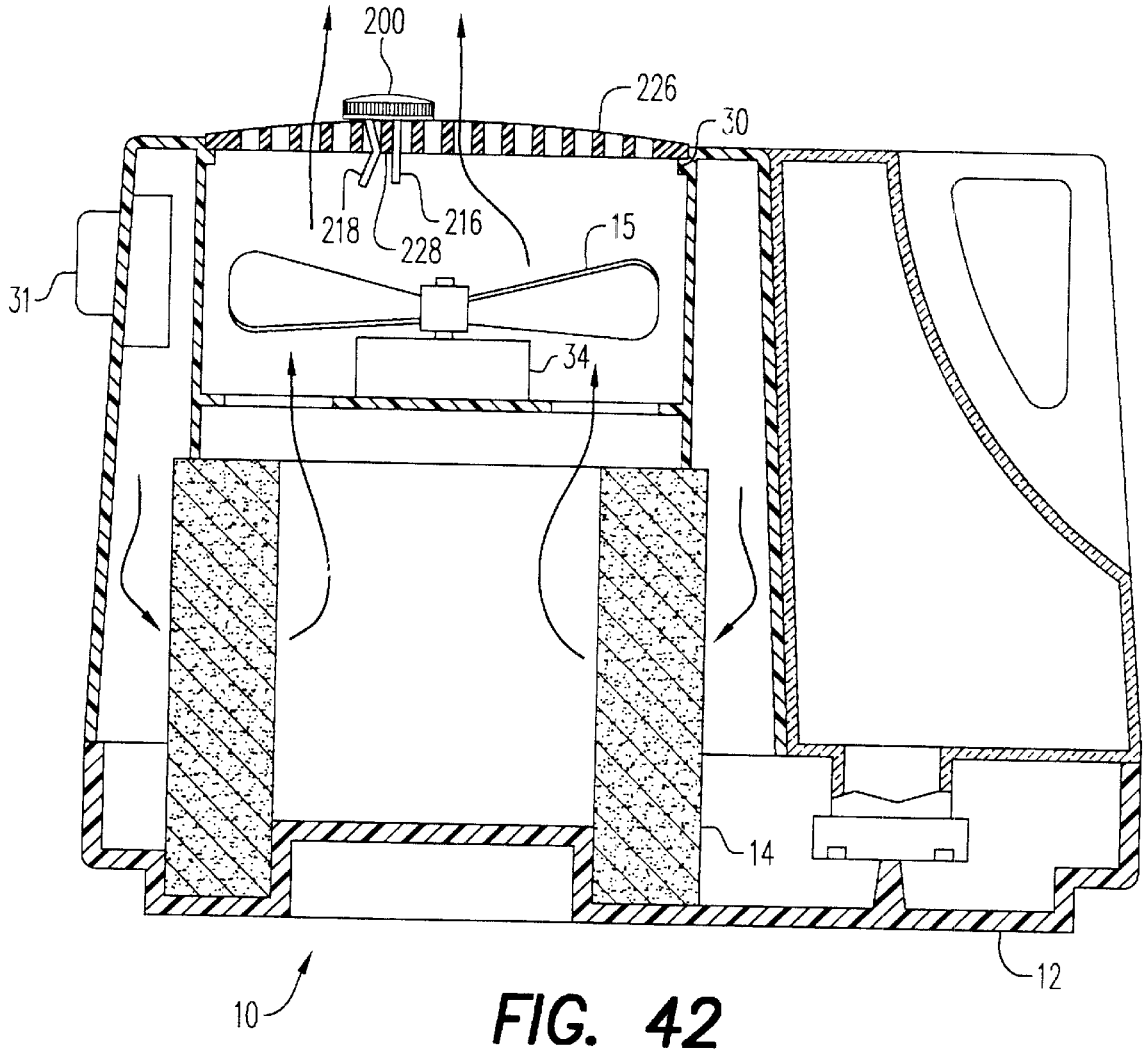
FIG. 42 is a cross-sectional view of the humidifier shown in FIG. 41 with the performance indicator attached.

Referring now to FIGS. 33 through 36, the operation of the wick change indicator 16 shown in FIGS. 28 through 30 will be explained. When the ambient-relative humidity is low, a good wick 14 installed in the humidifier 10, and the humidifier 10 is turned on, there is a difference between the ambient-relative humidity and the exit-relative humidity values as shown in FIG. 33 which provides an indication that the wick is good. However, when the ambient-relative humidity is low, a bad wick 14 is installed in the humidifier 10, and the humidifier 10 is turned on, there is generally only a small difference between the ambient-relative humidity and the exit-relative humidity values as shown in FIG. 34 which provides an indication that the wick is bad.

Figure 36:
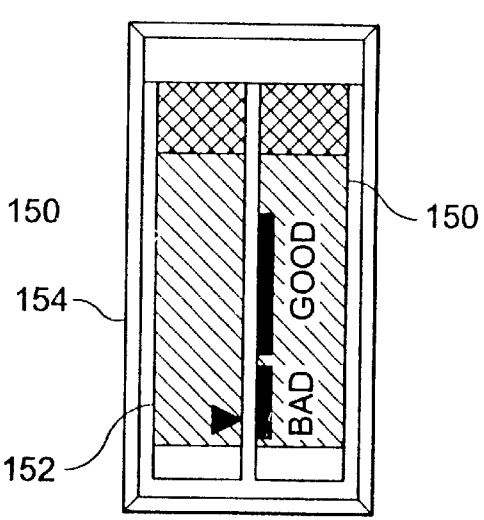
FIG. 36 is a view of the display of the embodiment of the invention shown in FIG. 28 when the humidifier is on, the ambient-relative humidity is high, and the wick is bad.
Figure 35:
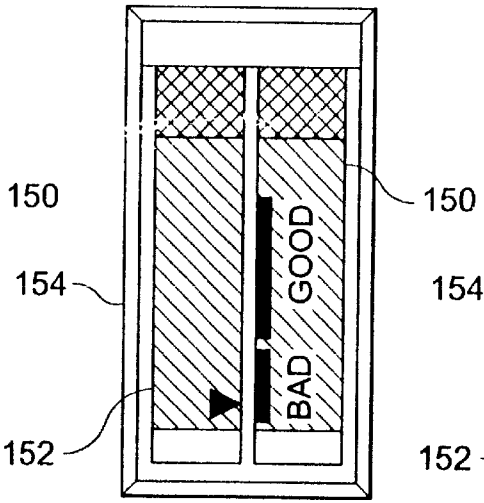
FIG. 35 is a view of the display of the embodiment of the invention shown in FIG. 28 when the humidifier is on, the ambient-relative humidity is high, and the wick is good.

Referring now to FIGS. 35 and 36, when the ambient-relative humidity is already high, it is difficult to determine whether the wick 14 needs to be replaced for the same reasons described above with regard to the embodiment depicted in FIG. 12. Again this problem can be overcome through use of appropriate user instructions.

As mentioned above, the wick change indicator of the present invention may be configured for separate attachment to the housing of a humidifier or may be integrally formed as part of the housing. Referring now to FIGS. 37–42, a preferred form of a separately attachable wick change indicator 200 is shown. The wick change indicator 200 shown in FIGS. 37–42 is similar to those described above. It generally includes at least one humidity sensing means (not shown in FIGS. 37–42), and a display 202. The humidity sensing means is preferably a hygrometer including a humidity sensitive element, which may be of any type, e.g., mechanical, electrical or chemical label, described above. Additionally, the separately attachable wick change indicator 200 shown in FIGS. 37–42 may include two hygrometers, one for measuring the exit-relative humidity and one for measuring the ambient-relative humidity, as described above.

The display 202 is coupled to the at least one hygrometer for indicating when the wick 14 requires replacement based upon the measured exit-relative humidity reaching a predetermined value. The display 202 may include an indicating needle 204 coupled to the hygrometer through a support plate 206 having a visual display for indicating when the wick 14 requires replacement. The hygrometer/display assembly is supported on an attachment means 208 for removably attaching the indicator 200 to a humidifier. The attachment means 208 preferably includes a support surface 210 for supporting the hygrometer/display assembly and at least one opening 212 through the support surface for permitting the exiting air flow from the humidifier to make contact with the hygrometer. The attachment means 208 further preferably includes at least one finger 214 projecting downwardly from the support surface 210 for providing removable attachment of the wick change indicator 200 to an air outlet of a humidifier. Preferably, the attachment means 208 includes two straight fingers 216 projecting generally perpendicularly downward from the support surface 210 and a resilient finger 218 projecting downwardly from the support surface at an angle with respect to the straight fingers.

The attachment means 208 and hygrometer/display assembly are housed within a retaining ring 220 and a transparent cover 222 that is attached to the retaining ring. The retaining ring 220 includes an opening 224 for allowing the fingers 214 of the attachment means 208 to extend outwardly therefrom. The transparent cover 222 protects the components of the wick change indicator and allows the display to be visible therethrough.

The arrangement of the fingers 214 of the attachment means 208 allows for simple and secure attachment of the wick change indicator 200 to the air outlet 30 of the humidifier 10. Preferably, the air outlet 30 of the humidifier 10 includes a grill 226 for attachment of the wick change indicator. The wick change indicator 200 is simply slipped onto the grill 226 so that one or more of the slats 228 of the grill is positioned between the fingers 214 of the attachment means 208. The angled resilient finger 218 of the attachment means 208 provides a biasing force against the straddled slat 228 thereby frictionally retaining the wick change indicator 200 to the grill 226 of the humidifier 10. The wick change indicator 200 can be removed from the grill 226 by simply lifting the retaining ring of the indicator away from the grill until the resilient finger 218 disengages the slat. Thus, the removable wick change indicator 200 can be used on other humidifiers that are not provided with their own means to determine when the wick requires replacement.

As earlier discussed, the display 202 can also provide visual indication should the water level in the reservoir 28 be exhausted such that the exit-relative humidity is low or to indicate that the humidifier 10 is turned "off" and thus the exit-relative humidity would be equal to the ambient humidity. An example of such a display is shown in FIG. 2A, whereby the indicator 200 would take the form of an overall humidifier performance indicator. Alternatively, the indicator 200 can be configured to display only a "good" condition or a reservoir "fill" condition for those humidifiers that do not utilize a replaceable wick element. In these instances, if the indicator 200 is providing an indication that the unit is "off" or "fill", the user will know to check to ensure water is provided in the supply tank 18 and/or that unit has been turned on. Once the tank 18 is filled and the unit turned on, the needle 204 of indicator 200 will move from the "fill" position to the "good" condition.

In the operation of the humidifier 10, as earlier discussed, water from the tank fills the reservoir to a level so that the wick 14 is partially submerged. Water is drawn up into the non-immersed portion of the wick 14 by capillary action. The fan 15 generates an airflow that passes through the wick 14 where it picks up moisture and exits the humidifier 10 through the air outlet grill 226. The wick change indicator 200 attached to the grill 226 provides an indication that the wick requires replacement when the exit-relative humidity falls below a predetermined value.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A humidifier for providing moisture into an airflow to humidify air in a room having an ambient-relative humidity, the humidifier comprising:

a housing having an air inlet, an air outlet and a reservoir for holding water;

a wick which is seated in the reservoir;

a fan provided within the housing for creating the airflow, the airflow entering the air inlet, passing through the wick for adding moisture to the air and exiting through the air outlet into the room, the exiting air having an exit-relative humidity associated therewith; and a wick change indicator removably attached to the air outlet, the wick change indicator including:

a hygrometer positioned within the airflow for measuring the exit-relative humidity of the airflow; and a display coupled to the hygrometer for indicating when the wick requires replacement based upon the measured exit-relative humidity substantially reaching a predetermined value.

2. A humidifier as defined in claim 1, wherein said hygrometer comprises a humidity sensitive element and said display comprises an indicating needle coupled to said humidity sensitive element for providing a visual display that said wick requires replacement.

3. A humidifier as defined in claim 2, wherein said humidity sensitive element is a metallic coil.

4. A humidifier as defined in claim 1, wherein said display includes indicia to provide visual indication that said reservoir is empty.

5. A humidifier as defined in claim 1, wherein said hygrometer includes:

a label that is impregnated with a chemical that changes color as a function of humidity, said label having:

a first region that is light in color and darkens when the exit-relative humidity of the airflow reaches a first predetermined value; and a second region that is light in color and darkens when the exit-relative humidity of the airflow reaches a second predetermined value, wherein one of said first region and said second region define a set of indicia to form said display.

6. A humidifier as defined in claim 1, wherein said hygrometer is an electrical type and said display is a liquid crystal type calibrated to indicate that the wick requires replacement when the exit-relative humidity of the airflow falls below a predetermined humidity.

7. A humidifier as defined in claim 1, further comprising a second hygrometer to measure the ambient-relative humidity and including a means for comparing said exit-relative humidity with said ambient-relative humidity for indicating when the wick requires replacement.

8. A humidifier as defined in claim 1, wherein the air outlet includes a grill and wherein said wick change indicator further comprises an attachment means for removably attaching the wick change indicator to the grill of the air outlet, the attachment means comprising at least one finger projecting outwardly from the wick change indicator for engagement with the grill.

9. A humidifier as defined in claim 8, wherein the attachment means includes at least one straight finger projecting outwardly from the wick change indicator and at least one resilient finger projecting outwardly from the wick change indicator at an angle with respect to the straight finger, the at least one straight finger and the at least one resilient finger forming an open resilient jaw for attachment to the grill.

10. A humidifier as defined in claim 9, wherein the grill of the air outlet comprises a plurality of slats, at least one of said slats being frictionally held by the open resilient jaw of the attachment member.

11. A humidifier as defined in claim 1, wherein the wick change indicator further comprises a retaining ring and a transparent cover attached to the retaining ring for housing the hygrometer and the display therein.

12. A wick change indicator for a humidifier having a reservoir for holding water, a wick element seated in the reservoir and an air outlet for providing a flow of air having an exit-relative humidity associated therewith into a room having an ambient-relative humidity, the wick change indicator comprising:

a humidity sensing means positioned within the airflow for measuring the exit-relative humidity of the airflow;

display coupled to the humidity sensing means for indicating when the wick requires replacement based upon the measured exit-relative humidity substantially reaching a predetermined value; and an attachment means for removably attaching the wick change indicator to the air outlet.

13. A wick change indicator as defined in claim 12, wherein the attachment means comprises at least one finger projecting outwardly from the wick change indicator for engagement with a grill of the humidifier air outlet.

14. A wick change indicator as defined in claim 12, wherein said humidity sensing means is a hygrometer comprising a humidity sensitive element and said display comprises an indicating needle coupled to said humidity sensitive element for providing a visual display that said wick requires replacement.

15. A wick change indicator as defined in claim 14, wherein said humidity sensitive element is a metallic coil.

16. A wick change indicator as defined in claim 12, wherein said display includes indicia to provide visual indication that said reservoir is empty.

17. A wick change indicator as defined in claim 12, wherein said humidity sensing means is a hygrometer comprising:

a label that is impregnated with a chemical that changes color as a function of humidity, said label having:

a first region that is light in color and darkens when the exit-relative humidity of the airflow substantially reaches a first predetermined value; and a second region that is light in color and darkens when the exit-relative humidity of the airflow reaches a second predetermined value, wherein one of said first region and said second region define a set of indicia to form said display.

18. A wick change indicator as defined in claim 12, wherein said humidity sensing means is an electrical hygrometer and said display is a liquid crystal type calibrated to indicate that the wick requires replacement when the exit-relative humidity of the airflow falls below a predetermined humidity.

19. A wick change indicator as defined in claim 12, further comprising a second humidity sensing means to measure the ambient-relative humidity and including a means for comparing said exit-relative humidity with said ambient-relative humidity for indicating when the wick requires replacement.

20. A wick change indicator as defined in claim 12, wherein said attachment means includes at least one straight finger projecting outwardly from the wick change indicator and at least one resilient finger projecting outwardly from the wick change indicator at an angle with respect to the straight finger, the at least one straight finger and the at least one resilient finger forming an open resilient jaw for attachment to a grill of the humidifier air outlet.

21. A wick change indicator as defined in claim 12, wherein the wick change indicator further comprises a retaining ring and a transparent cover attached to the retaining ring for housing the humidity sensing means and the display therein.

22. An indicator for indicating the need to refill a water supply to a room humidifier of the type having an air outlet for providing a flow of air having an exit-relative humidity associated therewith into a room having an ambient-relative humidity, the indicator comprising:

a humidity sensing means positioned within the airflow for measuring the exit-relative humidity of the airflow;

a display coupled to the humidity sensing means for indicating when the water supply needs refilling based upon the measured exit-relative humidity substantially reaching a predetermined value; and an attachment means for removably attaching the indicator to the air outlet.

23. An indicator as defined in claim 22, wherein the attachment means comprises at least one finger projecting outwardly from the indicator for engagement with a grill of the humidifier air outlet.

24. An indicator as defined in claim 22, wherein said humidity sensing means is a hygrometer comprising a humidity sensitive element and said display comprises an indicating needle coupled to said humidity sensitive element for providing a visual display that the water supply needs refilling.

25. An indicator as defined in claim 22, further comprising a second humidity sensing means to measure the ambient-relative humidity and including a means for comparing said exit-relative humidity with said ambient-relative humidity for indicating when the water supply needs refilling.

26. An indicator as defined in claim 22, wherein said attachment means includes at least one straight finger projecting outwardly from the indicator and at least one resilient finger projecting outwardly from the indicator at an angle with respect to the straight finger, the at least one straight finger and the at least one resilient finger forming an open resilient jaw for attachment to a grill of the humidifier air outlet.

27. A method for determining when a wick element of a humidifier requires replacement comprising the steps of:

providing a wick change indicator having a humidity sensing means and a display coupled to the humidity sensing means;

attaching the wick change indicator to an air outlet of the humidifier;

sensing the exit-relative humidity of air flowing from the air outlet of the humidifier with the humidity sensing means of the wick change indicator; and indicating on the display of the wick change indicator that a predetermined humidity level has been substantially reached to indicate that the wick element should be replaced.

28. A method for determining when a water supply of a humidifier requires refilling comprising the steps of:

providing an indicator having a humidity sensing means and a display coupled to the humidity sensing means;

attaching the indicator to an air outlet of the humidifier;

sensing the exit-relative humidity of air flowing from the air outlet of the humidifier with the humidity sensing means of the indicator; and indicating on the display of the indicator that a predetermined humidity level has been substantially reached to indicate that the water supply should be refilled.

29. A method for determining both the need to replace a wick element of a humidifier and the need to refill a water supply of the humidifier comprising the steps of:

providing an indicator having a humidity sensing means and a display coupled to the humidity sensing means;

attaching the indicator to an air outlet of the humidifier;

sensing the exit-relative humidity of air flowing from the air outlet of the humidifier with the humidity sensing means of the indicator; and indicating on the display of the indicator that a predetermined humidity level has been substantially reached to indicate that either the wick element should be replaced or the water supply should be refilled.

* * * * *